US011732891B2

(12) United States Patent
Carroll et al.

(10) Patent No.: US 11,732,891 B2
(45) Date of Patent: Aug. 22, 2023

(54) COMBUSTION SYSTEM WITH INFERRED FUEL AND ASSOCIATED METHODS

(71) Applicant: ONPOINT TECHNOLOGIES, LLC, Wichita, KS (US)

(72) Inventors: Chad Carroll, Tulsa, OK (US); Thomas Korb, Tulsa, OK (US); Ryan Morgan, Tulsa, OK (US); Mark Vaccari, Broken Arrow, OK (US)

(73) Assignee: ONPOINT TECHNOLOGIES, LLC, Wichita, KS (US)

( * ) Notice: Subject to any disclaimer, the term of this patent is extended or adjusted under 35 U.S.C. 154(b) by 0 days.

(21) Appl. No.: 17/624,322

(22) PCT Filed: Jun. 19, 2020

(86) PCT No.: PCT/IB2020/055819

§ 371 (c)(1),
(2) Date: Dec. 31, 2021

(87) PCT Pub. No.: WO2020/255089

PCT Pub. Date: Dec. 24, 2020

(65) Prior Publication Data

US 2022/0349577 A1 Nov. 3, 2022

Related U.S. Application Data

(60) Provisional application No. 62/864,954, filed on Jun. 21, 2019.

(51) Int. Cl.
*F23N 5/00* (2006.01)

(52) U.S. Cl.
CPC ..... *F23N 5/006* (2013.01); *F23N 2239/04* (2020.01); *F23N 2900/05001* (2013.01); *F23N 2900/05003* (2013.01)

(58) Field of Classification Search
None
See application file for complete search history.

(56) References Cited

U.S. PATENT DOCUMENTS 4,241,869 A 12/1980 Cratin, Jr.
4,927,351 A 5/1990 Hagar et al.
(Continued)

FOREIGN PATENT DOCUMENTS

CN 205317749 U 6/2016
CN 107525066 B 1/2019
(Continued)

OTHER PUBLICATIONS

Extended European search report and Opinion received for EP Application No. 21212579.3, dated May 30, 2022, 6 pages.
(Continued)

*Primary Examiner* — Jason Lau

(57) ABSTRACT

Systems and methods operate to infer a fuel composition in a combustion system. The fuel composition may be inferred by receiving measured operating parameters including one or more of fuel data defining fuel characteristics used in combustion within a heater of the combustion system, emissions data defining emission gasses exiting the heater, airflow data defining ambient air being supplied to the heater and airflow rate of the air within the heater. One or more relationships within the measured operating parameters may be identified that result in a list of potential fuel compositions. One of the potential fuel compositions from the list may be selected having sufficient likelihood of resulting in the measured operating parameters as an inferred fuel composition. The output the inferred fuel composition to a heater controller of the combustion system and used for automatic control thereof.

29 Claims, 12 Drawing Sheets

(56) References Cited

U.S. PATENT DOCUMENTS

| | | | |
|---|---|---|---|
| 8,727,767 | B2 | 5/2014 | Watson et al. |
| 9,506,649 | B2 | 11/2016 | Rennie et al. |
| 2003/0136318 | A1 | 7/2003 | Brown et al. |
| 2004/0224268 | A1 | 11/2004 | Keller et al. |
| 2006/0015298 | A1 | 1/2006 | Daw et al. |
| 2012/0102967 | A1 | 5/2012 | Kirzhner et al. |
| 2013/0173074 | A1 | 7/2013 | Chandler |
| 2013/0302738 | A1 | 11/2013 | Rennie et al. |
| 2014/0011148 | A1 | 1/2014 | Hemmann et al. |
| 2015/0152791 | A1 | 6/2015 | White |
| 2015/0337741 | A1 | 11/2015 | Gassner et al. |
| 2016/0209031 | A1 | 7/2016 | Lou et al. |
| 2017/0167727 | A1 | 6/2017 | Benum et al. |
| 2020/0408154 | A1 | 12/2020 | Geipel et al. |

FOREIGN PATENT DOCUMENTS

| | | | | |
|---|---|---|---|---|
| DE | 4032347 | A1 | 4/1992 | |
| DE | 102014118190 | A1 | 6/2016 | |
| DE | 102019101190 | A1 * | 7/2020 | ..... F23N 1/022 |
| EP | 2216386 | A1 | 8/2010 | |
| EP | 2920515 | A1 | 9/2015 | |
| EP | 2993401 | A1 | 3/2016 | |
| WO | 2010092080 | A1 | 8/2010 | |
| WO | 2020255089 | A1 | 12/2020 | |
| WO | 2020255090 | A1 | 12/2020 | |
| WO | 2020255091 | A1 | 12/2020 | |
| WO | 2020255092 | A1 | 12/2020 | |
| WO | 2020255093 | A1 | 12/2020 | |

OTHER PUBLICATIONS

Extended European Search Report received for EP Application No. 21212594.2, dated Mar. 25, 2022, 6 pages.

International Preliminary Report on Patentability received for PCT Application No. PCT/IB2020/055819, dated Dec. 30, 2021, 07 Pages.

International Preliminary Report on Patentability received for PCT Application No. PCT/IB2020/055821, dated Dec. 30, 2021, 10 Pages.

International Preliminary Report on Patentability received for PCT Application No. PCT/IB2020/055822, dated Dec. 30, 2021, 09 Pages.

International Preliminary Report on Patentability received for PCT Application No. PCT/IB2020/055823, dated Dec. 30, 2021, 08 Pages.

International Preliminary Report on Patentability received for PCT Application No. PCT/IB2020/055824, dated Dec. 30, 2021, 13 Pages.

International Search Report and Written Opinion received for PCT Application No. PCT/IB2020/055819, dated Nov. 4, 2020, 08 Pages.

International Search Report and Written Opinion received for PCT Application No. PCT/IB2020/055821, dated Oct. 26, 2020, 14 Pages.

International Search Report and Written Opinion received for PCT Application No. PCT/IB2020/055822, dated Oct. 16, 2020, 12 Pages.

International Search Report and Written Opinion received for PCT Application No. PCT/IB2020/055823, dated Sep. 2, 2020, 10 Pages.

International Search Report and Written Opinion received for PCT Application No. PCT/IB2020/055824, dated Oct. 13, 2020, 15 Pages.

Liu Xingrang et al."Integrating multi-objective optimization with computational fluid dynamics to optimize boiler combustion process of a coal fired power plant", Applied Energy, Elsevier SciencePublishers, vol. 130, Oct. 1, 2014, pp. 658-669. (Abstract).

Notice of Allowance received for EP Application No. 20743798.9, dated Oct. 1, 2021, 07 Pages.

Notice of Allowance received for EP Application No. 20744106.4, dated Nov. 3, 2021, 08 Pages.

Office Action received for EP Application No. 20743798.9, dated Jun. 16, 2021, 04 Pages.

Office Action received for EP Application No. 20744105.6, dated Jun. 16, 2021, 04 Pages.

Office Action received for EP Application No. 20744105.6, dated Sep. 30, 2021, 04 Pages.

Office Action received for EP Application No. 20744106.4, dated Jun. 17, 2021, 04 Pages.

Non-Final Rejection received for U.S. Appl. No. 17/624,324, dated Dec. 5, 2022, 11 pages.

* cited by examiner

| Mechanism | Formation | Important for |
|---|---|---|
| Fuel | Oxidation of organically-bound nitrogen in fuel (complicated chemistry) | Fuels w/organically-bound nitrogen (e.g., residual oil) |
| Thermal | Higher temperature oxidation of N & O:<br>$O + N_2 \leftrightarrow NO + N$<br>$N + O_2 \leftrightarrow NO + O$<br>$N + OH \leftrightarrow NO + H$ | Gaseous fuel firing |
| Prompt | Fast reaction of hydrocarbon fragments near beginning of flame (complicated chemistry)<br>$CH + N_2 \leftrightarrow HCN + N$ (most important) | Fuel rich parts of flames |
| $N_2O$ | Recombination reaction:<br>$O + N_2 + M \leftrightarrow N_2O + M$<br>$O + N_2O \leftrightarrow 2NO$<br>$H + N_2O \leftrightarrow NO + NH$ | High pressure flames (e.g. engines, turbines) |
| NNH | In flame fronts with high atom concentrations (e.g., O, H):<br>$O + NNH \rightarrow NO + NH$ | Very high temperature flames (e.g., oxy-fuel) |

FIG. 13

COMBUSTION SYSTEM WITH INFERRED FUEL AND ASSOCIATED METHODS

CROSS-REFERENCE TO RELATED APPLICATIONS

This application claims priority to, and benefits from U.S. Provisional Application Ser. No. 62/864,954, filed Jun. 21, 2019. This application is also related to each of: U.S. Provisional Application Ser. No. 62/864,967, filed Jun. 21, 2019; U.S. Provisional Application Ser. No. 62/864,992, filed Jun. 21, 2019; U.S. Provisional Application Ser. No. 62/864,997, filed Jun. 21, 2019; U.S. Provisional Application Ser. No. 62/865,007, filed Jun. 21, 2019; U.S. Provisional Application Ser. No. 62/865,021, filed Jun. 21, 2019; and U.S. Provisional Application Ser. No. 62/865,031, filed Jun. 21, 2019. The entire contents of each of the aforementioned applications are incorporated herein as if fully set forth.

BACKGROUND

Combustion processes, such as those used in process fired heaters, boilers, and the like, are used extensively throughout multiple industries for heating, vaporizing, or thermal cracking of various process fluids. Operation and maintenance of these combustion processes is challenging because incomplete or variable combustion can result in product variability, thermal stress on the equipment, environmental threats, and, if severe, unit explosions.

In many combustion systems, the measured fuel composition is a critical aspect to ensure that the control system will always provide enough and the proper amount of excess air to the combustion process. If a combustion process were to drop below a stoichiometric amount of combustion air for a given fuel flow, a detonation could easily result. This is known as sub-stoichiometric combustion, heater bogging, or heater flooding. This combustion risk can easily occur if a fuel composition were to change without the airflow rate adjusting accordingly.

In other combustion processes, the fuel composition must be known to ensure the combustion system can be manipulated to stay within specific emissions limits (e.g., NOx emissions, smokeless capacity, CO emissions, destruction efficiency, etc.).

In applications where the fuel composition is likely to change, the fuel may be sampled to determine the fuel composition directly, and then that new fuel composition is used to calculate the new required airflow. This method is typically compensated/biased by the excess oxygen measured within the firebox. This method is often not employed because it requires additional hardware such as full fuel composition-measurement devices located at the source of the fuel. These full fuel composition-measurement devices must be able to respond quickly to process the data appropriately, and such devices that are capable of quick responses are expensive and troublesome to maintain.

To avoid fuel composition measurements, it is most common in the process heater industry to apply a single fuel air ratio curve of a known fuel (natural gas for instance), and then bias the curve based on easier to measure fuel property information. This method also biases based on the measured oxygen within the firebox. This approach allows some knowledge of fuel composition properties to be sampled faster and cheaper than measuring the full fuel composition. The problem with this approach is that the full fuel composition is never known and recorded for troubleshooting or analytical purposes. It also greatly approximates the required fuel air ratio and depends heavily on the measured firebox excess oxygen.

Accordingly, a need in the process heater industry exists to provide alternative ways to more accurately determine the fuel composition without the application of costly fuel measurement devices.

BRIEF DESCRIPTION OF THE FIGURES

The foregoing and other features and advantages of the disclosure will be apparent from the more particular description of the embodiments, as illustrated in the accompanying drawings, in which like reference characters refer to the same parts throughout the different figures. The drawings are not necessarily to scale, emphasis instead being placed upon illustrating the principles of the disclosure.

FIG. 13 depicts example mechanisms that form $NO_X$ emissions within the system.

DETAILED DESCRIPTION OF THE EMBODIMENTS

Figure 1:
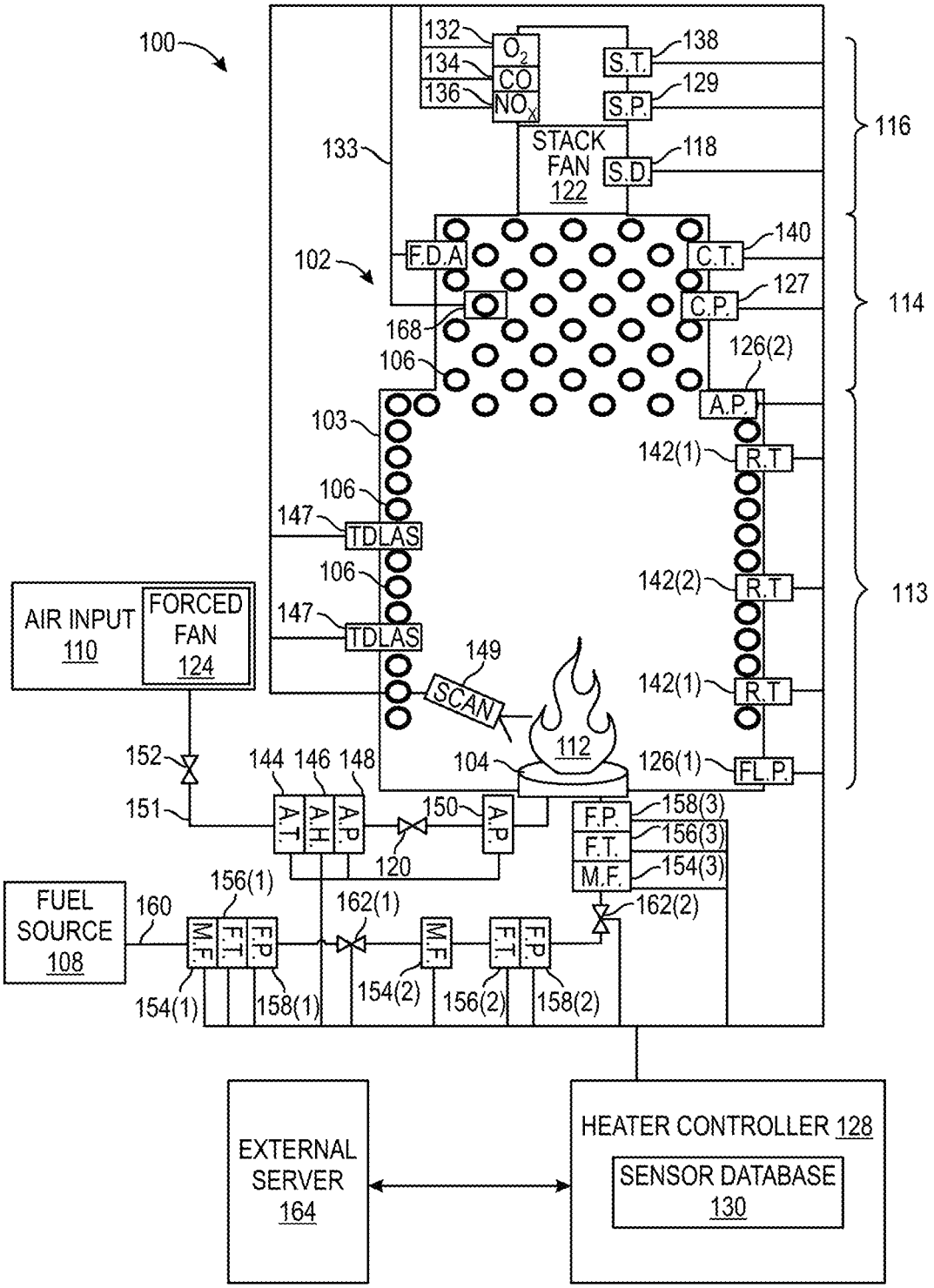
FIG. 1 depicts an example system of a process heater with automatic air register setting determination, in embodiments.

FIG. 1 depicts an example system 100 of a process heater with intelligent monitoring system, in embodiments. The system 100 includes a heater 102 that is heated by one or more burners 104 located in the housing 103 thereof. Heater 102 can have any number of burners 104 therein, each operating under different operating conditions (as discussed in further detail below). Moreover, although FIG. 1 shows a burner located on the floor of the heater 102, one or more burners may also be located on the walls and/or ceiling of the heater 102 without departing from the scope hereof (indeed, heaters in the industry often have over 100 burners). Further, the heater 102 may have different configurations, for example a box heater, a cylindrical heater, a cabin heater, and other shapes, sizes, etc. as known in the art.

Burner 104 provides heat necessary to perform chemical reactions or heat up process fluid in one or more process tubes 106 (not all of which are labeled in FIG. 1. Any number of process tubes 106 may be located within the heater 102, and in any configuration (e.g., horizontal, vertical, curved, off-set, slanted, or any configuration thereof). Burner 104 is configured to combust a fuel source 108 with an oxidizer such as air input 110 to convert the chemical energy in the fuel into thermal energy 112 (e.g., a flame). This thermal energy 112 then radiates to the process tubes 106 and is transferred through the process tubes 106 into a material therein that is being processed. Accordingly, the heater 102 typically has a radiant section 113, a convection section 114, and a stack 116. Heat transfer from the thermal energy 112 to the process tubes 106 primarily occurs in the radiant section 113 and the convection section 114.

Airflow into the heater 102 (through the burner 104) typically occurs in one of four ways natural, induced, forced, and balanced.

A natural induced airflow draft occurs via a difference in density of the flue gas inside the heater 102 caused by the combustion. There are no fans associated in a natural induced system. However, the stack 116 includes a stack damper 118 and the burner includes a burner air register 120 that are adjustable to change the amount of naturally induced airflow draft within the heater 102.

An induced airflow draft system includes a stack fan (or blower) 122 located in the stack (or connected to the stack) 116. In other or additional embodiments, other motive forces than a fan are be used to create the induced draft, such as steam injection to educts flue gas flow through the heater. The stack fan 122 operates to pull air through the burner air register 120 creating the induced-draft airflow within the heater 102. The stack fan 122 operating parameters (such as the stack fan 122 speed and the stack damper 118 settings) and the burner air register 120 impact the draft airflow. The stack damper 118 may be a component of the stack fan 122, or separate therefrom.

A forced-draft system includes an air input forced fan 124 that forces air input 110 into the heater 102 via the burner 104. The forced fan 124 operating parameters (such as the forced fan 124 speed and the burner air register 120 settings) and the stack damper 118 impact the draft airflow. The burner air register 120 may be a component of the forced fan 124, but is commonly separate therefrom and a component of the burner 104.

A balanced-draft system includes both the air input forced fan 124 and the stack fan 122. Each fan 122, 124 operate in concert, along with the burner air register 120 and stack damper 118 to control the airflow and draft throughout the heater 102.

Figure 2:
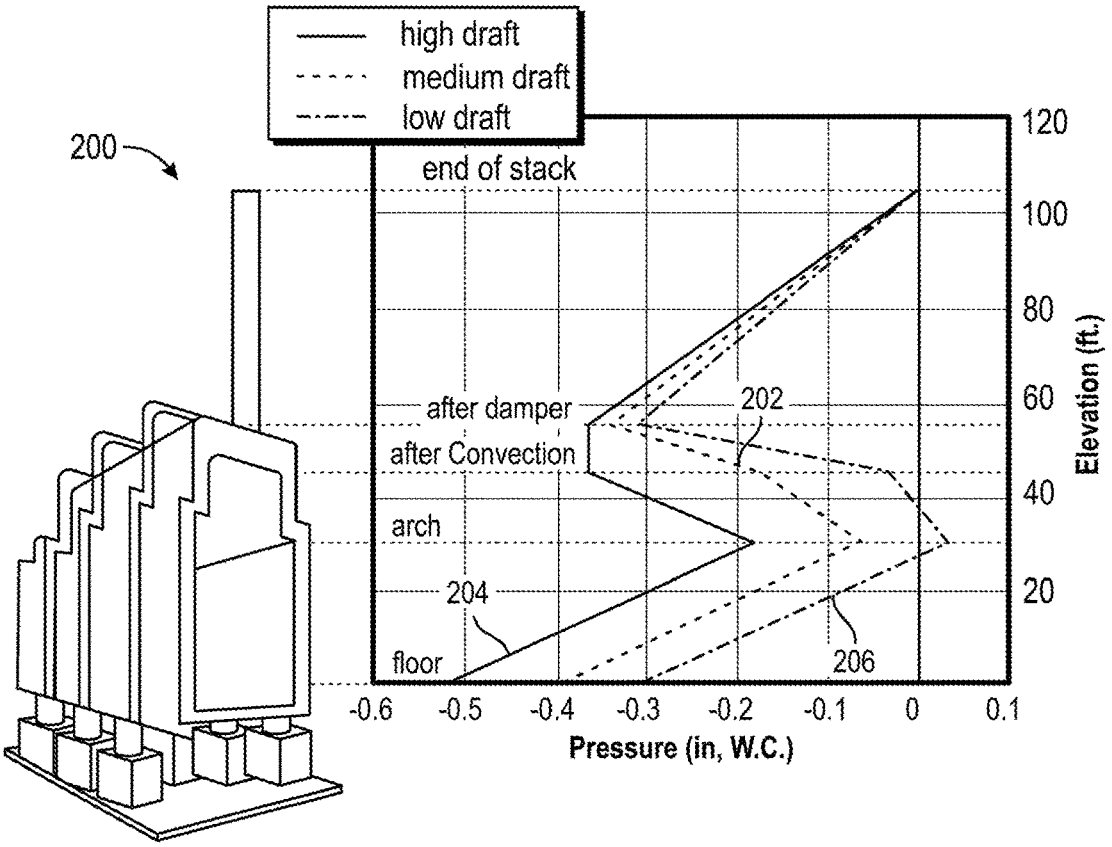
FIG. 2 depicts a typical draft profile throughout a heater (e.g., the heater of FIG. 1).

Draft throughout the heater 102 varies depending on the location within the heater 102. FIG. 2 depicts a typical draft profile 200 throughout a heater (e.g., heater 102). Line 202 depicts a desired draft that is consistent with the design of the heater and components therein. Line 204 depicts a high draft situation where pressure in the heater is more negative than desired (and thus further negative compared to atmospheric pressure outside of the heater). Line 206 depicts a low draft situation where pressure in the heater is more positive than desired (and thus closer to or greater than atmospheric pressure outside of the heater). As shown, by line 202, heaters are often designed to have a −0.1 pressure at the arch of the heater.

Figure 3:
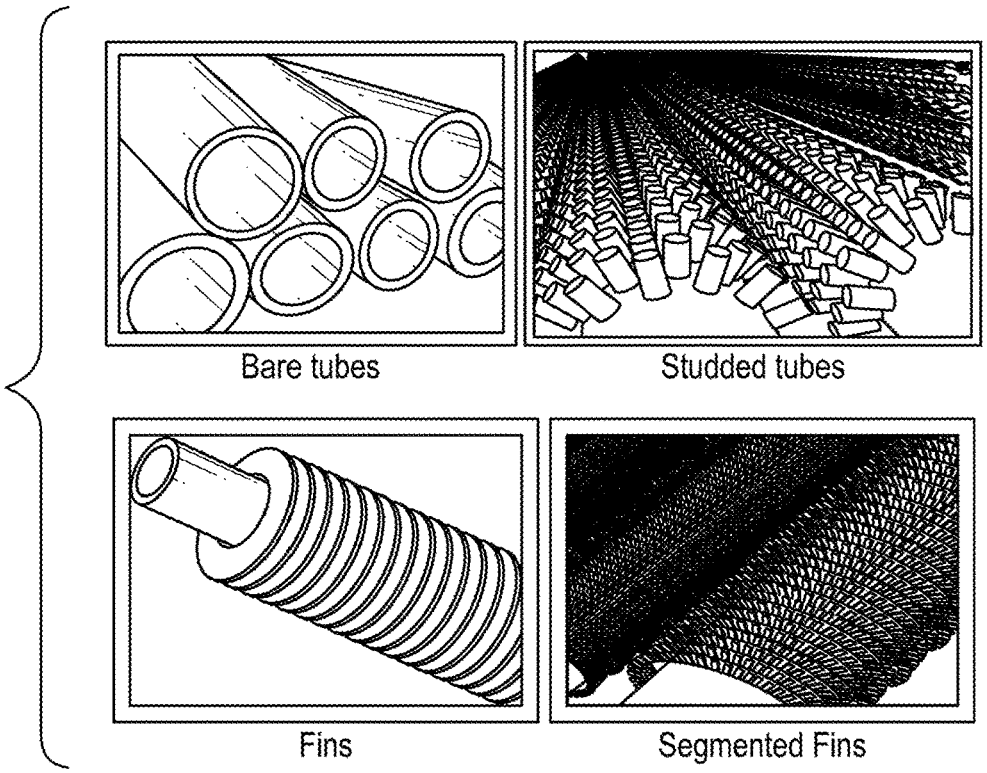
FIG. 3 depicts a plurality of example process tube types.

Draft throughout the heater 102 is also be impacted based on the geometry of the heater and components thereon. For example, draft is strongly a function of heater 102 height. The taller the heater 102, the more negative the draft will be at the floor of the heater 102 to maintain the same draft level at the top of the heater 102 (normally −0.1 in $H_2O$). The components greatly impact the draft. For example, FIG. 3 depicts a plurality of process tube types. The convection section process tubes 106 may or may not have heat sink fins thereon to manage the heat transfer from the thermal energy 112 to the process tube 106. These convection section fins may plug or corrode overtime-varying the required draft within a heater as compared to the designed draft for the same heater with the same components. As the convection section flue gas channel open area begins to decrease, a greater pressure differential is required to pull the same quantity of flue gas through the convection section.

Referring to FIG. 1, pressure (indicating draft) within the heater 102 is measured at a variety of locations in the heater respectively via one of a plurality of pressure sensors. Floor pressure sensor 126(1) measures the pressure at the floor of the heater 102. Arch pressure sensor 126(2) measures the pressure at the arch of the heater 102 where the radiant section 113 transitions to the convection section 114. Convection pressure sensor 127 measures the pressure of the convection section 114. Stack pressure sensor 129, if included, measures the pressure of the stack 116.

The pressure sensors 126, 127, 129 may include a manometer, or a Magnehelic draft gauge, where the pressure readings are manually entered into process controller 128 (or a handheld computer and then transferred wirelessly or via wired connection from the handheld computer to the process controller 128) including a sensor database 130 therein storing data from various components associated with the heater 102. The pressure sensors 126, 127, 129 may also include electronic pressure sensors and/or draft transmitters that transmit the sensed pressure to the process controller 128 via a wired or wireless connection 133. The wireless or wired connection 133 may be any communication protocol, including WiFi, cellular, CAN bus, etc.

The process controller 128 is a distributed control system (DCS) (or plant control system (PLC) used to control various systems throughout the system 100, including fuel-side control (e.g., control of components associated with getting fuel source 108 into the heater 102 for combustion therein), air-side control (e.g., control of components associated with getting air source 110 into the heater 102), internal combustion-process control (e.g., components associated with managing production of the thermal energy 112, such as draft within the heater 102), and post-combustion control (e.g., components associated with managing the emissions after production of the thermal energy 112 through the stack 116). The process controller 128 typically includes many control loops, in which autonomous controllers are distributed throughout the system 100 (associated with individual or multiple components thereof), and including a central operator supervisory control.

Figure 4:
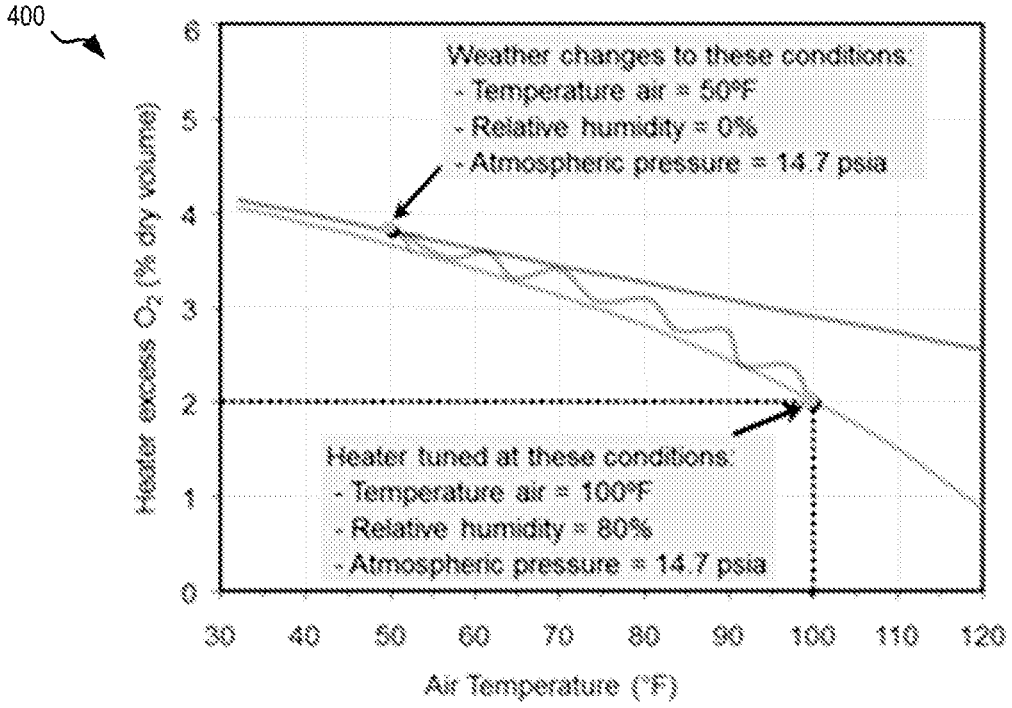
FIG. 4 depicts a diagram showing air temperature and humidity effects on sensed excess $O_2$ levels.

Operating conditions within the heater 102 (such as draft, and the stoichiometry associated with creating the thermal energy 112) are further impacted via atmospheric conditions, such as wind, wind direction, humidity, ambient air temperature, sea level, etc. FIG. 4 depicts a diagram 400 showing air temperature and humidity effects on sensed excess $O_2$ levels. The changes in operating conditions are often controlled by monitoring and manipulating the draft conditions within the heater 102. The stack dampers 118 are commonly digitally controlled, and therefore often controllable from the operating room of the system 100, via the process controller 128. However, many systems do not include burner air registers 120 that are digitally controlled. Because of this, system operators often control draft within the heater 102 using just an electronic stack damper (e.g., stack damper 118) thereby avoiding timely and costly manual operation of each burner air register (e.g., burner air register 120) associated with each individual burner (e.g., burner 104). This cost grows depending on the number of burners located in each heater—each heater may have over 100 burners therein.

Figure 5:
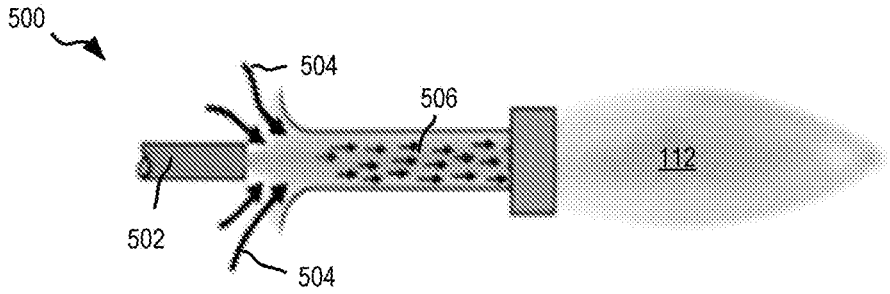
FIG. 5 depicts a schematic of air and fuel mixture in a pre-mix burner, in embodiments.
Figure 6:
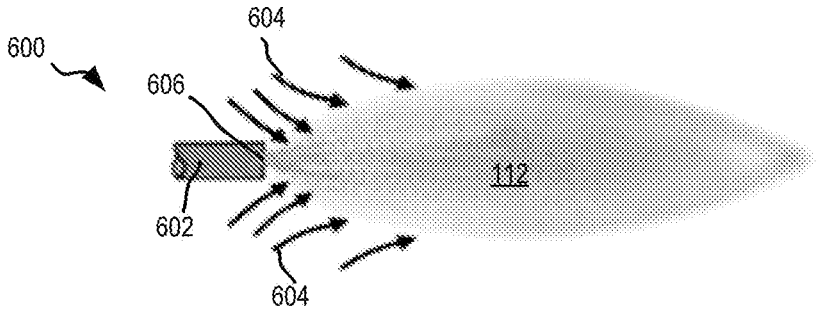
FIG. 6 depicts a schematic of air and fuel mixture in a diffusion burner, in embodiments.

In addition to the draft as discussed above, burner geometry plays a critical role in managing the thermal energy 112 produced in the heater 102. Each burner 104 is configured to mix the fuel source 108 with the air source 110 to cause combustion and thereby create the thermal energy 112. Common burner types include pre-mix burners and diffusion burners. FIG. 5 depicts a schematic 500 of air and fuel mixture in a pre-mix burner, in embodiments. In a pre-mix burner, kinetic energy of the fuel gas 502 draws some primary air 504 needed for combustion into the burner. The fuel and air mix to create an air/fuel mixture 504 having a specific air-to-fuel ratio prior to igniting to create the thermal energy 112. FIG. 6 depicts a schematic 600 of air and fuel mixture in a diffusion burner, in embodiments. In a diffusion burner, air 604 for combustion is drawn (by induced- or natural-draft) or pushed (by forced-, or balanced-draft) into the heater before mixing with the fuel 602. The mixture burns at the burner gas tip 606.

Figure 7:
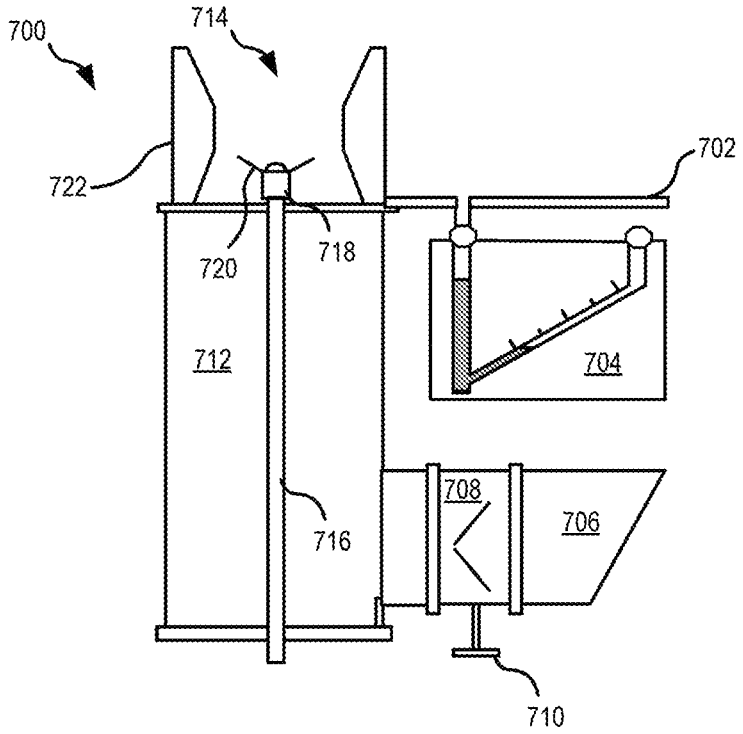
FIG. 7 depicts an example cutaway diagram of a burner, which is an example of the burner of FIG. 1.
Figure 8:
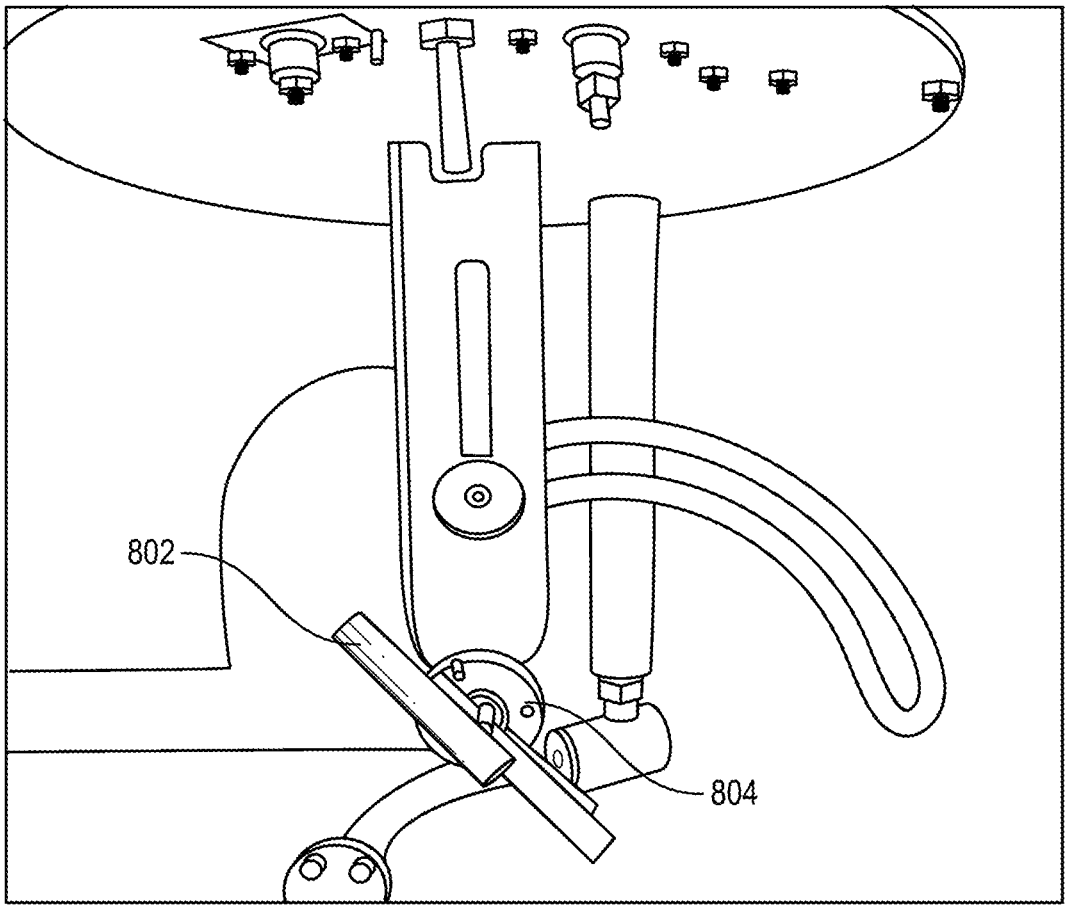
FIG. 8 depicts an example air register handle and indicator plate 804 that is manually controlled.

FIG. 7 depicts an example cutaway diagram of a burner 700, which is an example of the burner 104 of FIG. 1. Burner 700 is an example of a diffusion burner. Burner 700 is shown located mounted in a heater at the heater floor 702. Proximate the burner 700 in the heater floor 702 is a manometer 704, which is an example of the pressure sensors 126, 127, 129 discussed above. The manometer 704 may be another type of pressure sensor without departing from the scope hereof. Burner 700 is shown for a natural or induced-draft heater system, and includes a muffler 706 and a burner air register 708. Ambient air flows through the muffler 706 from outside the heater system. In a forced or balanced-draft system, the muffler 706 may not be included and instead be replaced with an intake ducting from the forced fan (e.g., forced fan 124 in FIG. 1). The burner air register 708 is an example of the burner air register 120 discussed above with respect to FIG. 1, and may be manipulated via an air register handle 710 to one of a plurality of settings defining how open or closed the air register 708 is. As discussed above, the air register handle 710 is typically manually controlled (although sometimes is fitted with an actuator, or provided with mechanical linkage and an actuator so a single actuator manipulates a plurality of burners). FIG. 8 depicts an example air register handle 802 and indicator plate 804 that is manually controlled. The input air then travels through the burner plenum 712 towards the burner output 714 where it is mixed with input fuel and ignited to combust and produce thermal energy (e.g., thermal energy 112 of FIG. 1).

Figure 9:
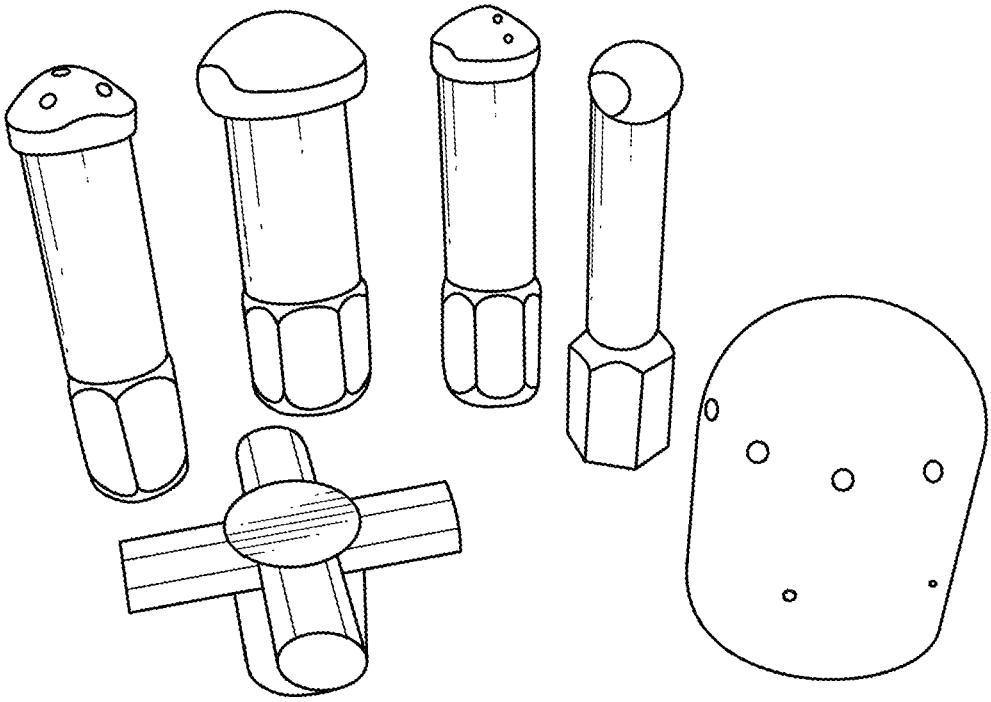
FIG. 9 depicts example burner tips with different shapes and sizes.
Figure 10:
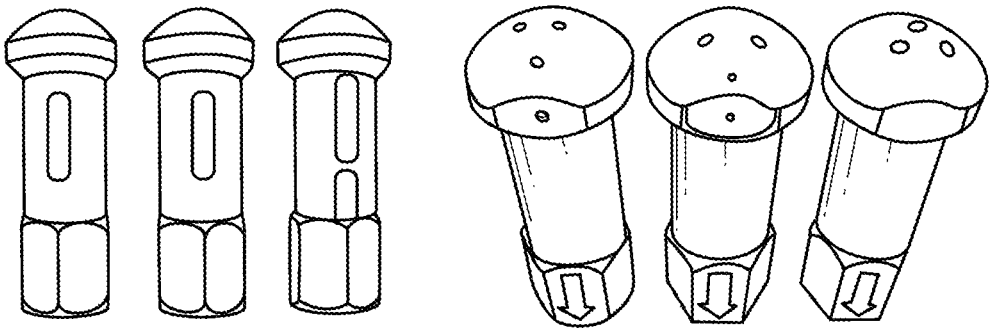
FIG. 10 depicts example burner tips with the same shape, but different drill hole configurations.

The fuel travels through a fuel line 716, and is output at a burner tip 718. The fuel may be disbursed on a deflector 720. The burner tip 718 and deflector 720 may be configured with a variety of shapes, sizes, fuel injection holes, etc. to achieve the desired combustion results (e.g., flame shaping, emissions tuning, etc.). FIG. 9 depicts example burner tips with different shapes and sizes. FIG. 10 depicts example burner tips with the same shape, but different drill hole configurations. Furthermore, one or more tiles 722 may be included at the burner output 714 to achieve a desired flame shape or other characteristic.

Referring to FIG. 1, control of the system 100 occurs both manually and digitally. As discussed above, various components, such as burner air register 120 are commonly manually controlled. However, the system 100 also includes a variety of sensors throughout the heater 102, the fuel-side input, and the air-side input used to monitor and control the system using the process controller 128.

At the stack 116, an oxygen sensor 132, a carbon monoxide sensor 134, and $NO_x$ sensor 136 can be utilized to monitor the condition of the exhaust and emissions leaving the heater 102 via the stack 116. Each of the oxygen sensor 132, carbon monoxide sensor 134, and $NO_X$ sensor 136 may be separate sensors, or part of a single gas-analysis system. The oxygen sensor 132, carbon monoxide sensor 134, and $NO_x$ sensor 136 are each operatively coupled to the process controller 128 via a wired or wireless communication link. These sensors indicate the state of combustion in the heater 102 in substantially real-time. Data captured by these sensors is transmitted to the process controller 128 and stored in the sensor database 130. By monitoring the combustion process represented by at least one of the oxygen sensor 132, carbon monoxide sensor 134, and $NO_x$ sensor 136, the system operator may adjust the process and combustion to stabilize the heater 102, improve efficiency, and/or reduce emissions. In some examples, other sensors, not shown, can be included to monitor other emissions (e.g., combustibles, methane, sulfur dioxide, particulates, carbon dioxide, etc.) on a real-time basis to comply with environmental regulations and/or add constraints to the operation of the process system. Further, although the oxygen sensor 132, carbon monoxide sensor 134, and $NO_x$ sensor 136 are shown in the stack 116, there may be additional oxygen sensor(s), carbon monoxide sensor(s), and $NO_x$ sensor(s) located elsewhere in the heater 102, such as at one or more of the convection section 114, radiant section 113, and/or arch of the heater 102. The above discussed sensors in the stack section may include a flue gas analyzer (not shown) prior to transmission to the process controller 128 that extract, or otherwise test, a sample of the emitted gas within the stack 116 (or other section of the heater) and perform an analysis on the sample to determine the associated oxygen, carbon monoxide, or $NO_x$ levels in the sample (or other analyzed gas). Other types of sensors include tunable laser diode absorption spectroscopy (TDLAS) systems that determine the chemical composition of the gas based on laser spectroscopy.

Flue gas temperature may also be monitored by the process controller 128. To monitor the flue gas temperatures, the heater 102 may include one or more of a stack temperature sensor 138, a convection sensor temperature sensor 140, and a radiant temperature sensor 142 that are operatively coupled to the process controller 128. Data from the temperature sensors 138, 140, 142 are transmitted to the process controller 128 and stored in the sensor database 130. Further, each section may have a plurality of temperature sensors—in the example of FIG. 1, there are three radiant section temperature sensors 142(1)-(3). The above discussed temperature sensors may include a thermocouple, suction pyrometer, and/or laser spectroscopy analysis systems that determine the temperature associated with the given temperature sensor.

The process controller 128 may further monitor air-side measurements and control airflow into the burner 104 and heater 102. Air-side measurement devices include an air temperature sensor 144, an air-humidity sensor 146, a pre-burner air register air pressure sensor 148, and a post-burner air register air pressure sensor 150. In embodiments, the post-burner air pressure is determined based on monitoring excess oxygen readings in the heater 102. The air-side measurement devices are coupled within or to the air-side ductwork 151 to measure characteristics of the air flowing into the burner 104 and heater 102. The air-temperature sensor 144 may be configured to sense ambient air temperatures, particularly for natural and induced-draft systems. The air-temperature sensor 144 may also be configured to detect air temperature just prior to entering the burner 104 such that any pre-heated air from an air-preheat system is taken into consideration by the process controller 128. The air-temperature sensor 144 may be a thermocouple, suction pyrometer, or any other temperature measuring device known in the art. The air humidity sensor 146 may be a component of the air temperature sensor, or may be separate therefrom, and is configured to sense the humidity in the air entering the burner 104. The air temperature sensor 144 and air humidity sensor 146 may be located upstream or downstream from the burner air register 120 without departing from the scope hereof. The pre-burner air register air pressure sensor 148 is configured to determine the air pressure before the burner air register 120. The post-burner air register air pressure sensor 150 is configured to determine the air pressure after the burner air register 120. The post-burner air register air pressure sensor 150 may not be a sensor measuring the furnace draft at the burner elevation, or other elevation and then calculated to determine the furnace draft at the burner elevation. Comparisons between the post-burner air register air pressure sensor 150 and the pre-burner air register air pressure sensor 148 may be made by the process controller to determine the pressure drop across the burner 104, particularly in a forced-draft or balanced-draft system. Air-side and temperature measurements discussed herein may further be measured using one or more TDLAS devices 147 located within the heater 102 (at any of the radiant section 113, convection section 114, and/or stack 116).

Burner 104 operational parameters may further be monitored using a flame scanner 149. Flame scanners 149 operate to analyze frequency oscillations in ultraviolet and/or infrared wavelengths of one or both of the main burner flame or the burner pilot light.

FIG. 1 also shows an air handling damper 152 that is located prior to the burner air register 120. The air-handling damper 152 includes any damper that impacts air-flow into the heater 102, such as a duct damper, variable speed fan, fixed-speed fan with air throttling damper, etc.) In certain system configurations, a single air input (including a given fan 124) supplies air to a plurality of burners, or a plurality of zones within a given heater. There may be any number of fans (e.g., forced fan 124), temperature sensors (e.g., air temperature sensor 144), air humidity sensors (e.g., air humidity sensor 146), air pressure sensors (e.g., pre-burner air register air pressure sensor 148) for a given configuration. Further, any of these air-side sensors may be located upstream or downstream from the air handling damper 152 without departing form the scope hereof.

The process controller 128 may further monitor fuel-side measurements and control fuel flow into the burner 104. Fuel-side measurement devices include one or more of flow sensor 154, fuel temperature sensor 156, and fuel-pressure sensor 158. The fuel-side measurement devices are coupled within or to the fuel supply line(s) 160 to measure characteristics of the fuel flowing into the burner 104. The flow sensor 154 may be configured to sense flow of the fuel through the fuel supply line 160. The fuel-temperature sensor 156 detects fuel temperature in the fuel supply line 160, and includes known temperature sensors such as a thermocouple. The fuel-pressure sensor 158 detects fuel-pressure in the fuel supply line 160.

The fuel line(s) 160 may have a plurality of fuel control valves 162 located thereon. These fuel control valves 162 operate to control the flow of fuel through the supply lines 160. The fuel control valves 162 are typically digitally controlled via control signals generated by the process controller 128. FIG. 1 shows a first fuel control valve 162(1) and a second fuel control valve 162(2). The first fuel control valve 162(1) controls fuel being supplied to all burners located in the heater 102. The second fuel control valve 162(2) controls fuel being supplied to each individual burner 104 (or a grouping of burners in each heater zone). There may be more or fewer fuel control valves 162 without departing from the scope hereof. Further, as shown, there may be a grouping of fuel-side measurement devices between individual components on the fuel supply line 160. For example, a first flow sensor 154(1), first fuel temperature sensor 156(1), and first fuel-pressure sensor 158(1) are located on the fuel supply line 160 between the fuel source 108 and the first fuel control valve 162(1). A second flow sensor 154(2), second fuel temperature sensor 156(2), and second fuel-pressure sensor 158(2) are located on the fuel supply line 160 between the first fuel control valve 162(1) and the second fuel control valve 162(2). Additionally, a third flow sensor 154(3), third fuel temperature sensor 156(3), and third fuel-pressure sensor 158(3) are located on the fuel supply line 160 between the second fuel control valve 162(2) and the burner 104. The third fuel temperature sensor 156(3), and third fuel-pressure sensor 158(3) may be configured to determine flow, temperature, and pressure respectively of an air/fuel mixture for pre-mix burners discussed above with respect to FIG. 5.

The process controller 128 may also measure process-side temperatures associated with the processes occurring within the process tubes 106. For example, system 100 may further include one or more tube temperature sensors 168, such as a thermocouple, that monitor the temperature of the process tubes 106. The temperature sensor 168 may also be implemented using optical scanning technologies, such as an IR camera, and/or one of the TDLAS devices 147. Furthermore, the heater controller 128 may also receive sensed outlet temperature of the fluid within the process tubes 106 from process outlet temperature sensor (not shown), such as a thermocouple. The process controller 128 may then use these sensed temperatures (from the tube temperature sensors 168 and/or the outlet temperature sensor) to control firing rate of the burners 104 to increase or decrease the generated thermal energy 112 to achieve a desired process temperature.

Figure 11:
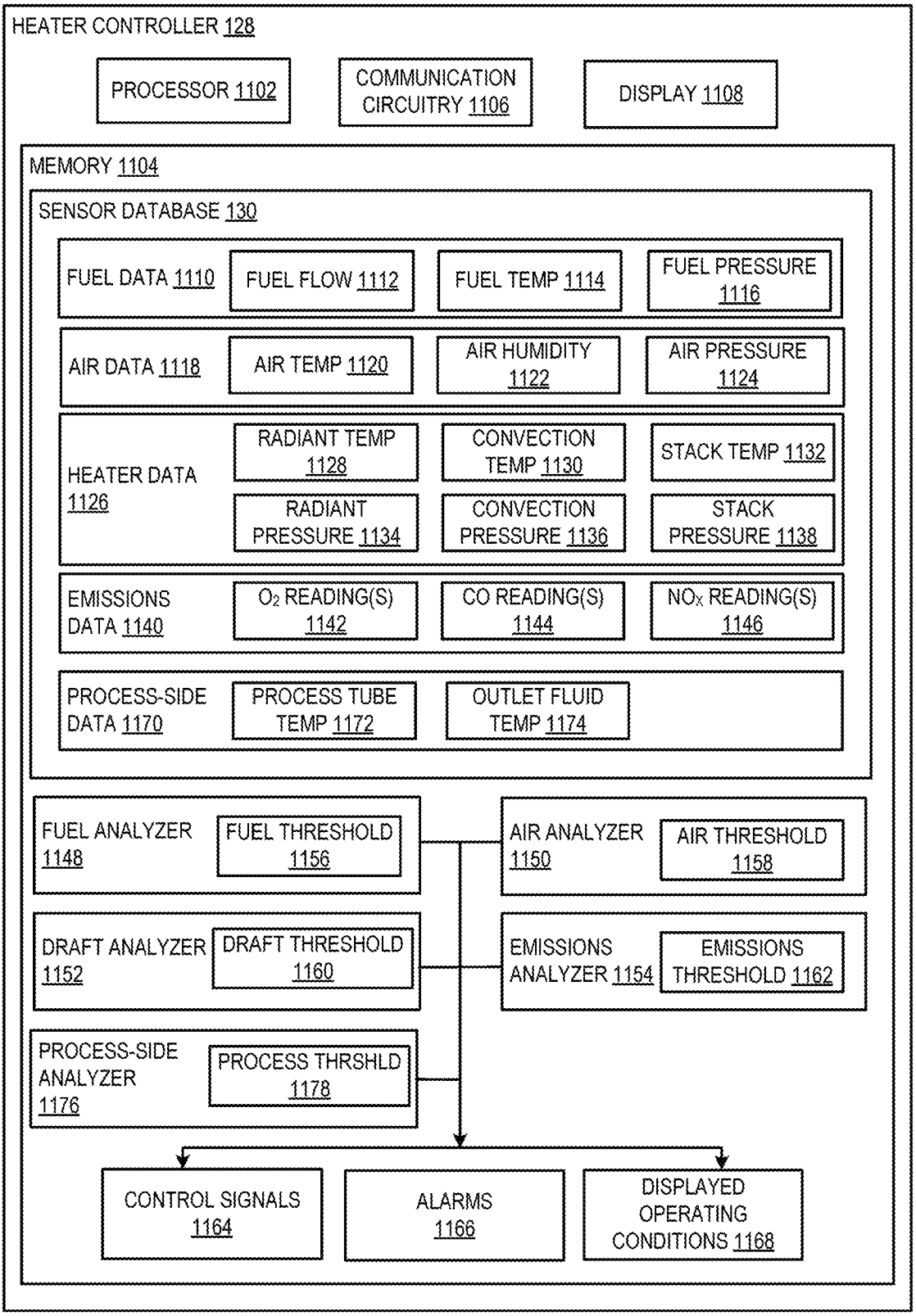
FIG. 11 depicts a block diagram of the heater controller of FIG. 1 in further detail, in embodiments.

FIG. 11 depicts a block diagram of the process controller 128 of FIG. 1 in further detail, in embodiments. The process controller 128 includes a processor 1102 communicatively coupled with memory 1104. The processor 1102 may include a single processing device or a plurality of processing devices operating in concert. The memory 1104 may include transitory and or non-transitory memory that is volatile and/or non-volatile.

The process controller 128 may further include communication circuitry 1106 and a display 1108. The communication circuitry 1106 includes wired or wireless communication protocols known in the art configured to receive and transmit data from and to components of the system 100. The display 1108 may be co-located with the process controller 128, or may be remote therefrom and displays data about the operating conditions of the heater 102 as discussed in further detail below.

Memory 1104 stores the sensor database 130 discussed above, which includes any one or more of fuel data 1110, air data 1118, heater data 1126, emissions data 1140, process-side data 1170, and any combination thereof. In embodiments, the sensor database 130 includes fuel data 1110. The fuel data 1110 includes fuel flow 1112, fuel temperature 1114, and fuel-pressure 1116 readings throughout the system 100 regarding the fuel being supplied to the burner 104. For example, the fuel flow data 1112 includes sensed readings from any one or more of the flow sensor(s) 154 in system 100 transmitted to the process controller 128. The fuel temperature data 1114 includes sensed readings from any one or more of the fuel temperature sensor(s) 156 in system 100 transmitted to the process controller 128. The fuel-pressure data 1116 includes sensed readings from any one or more of the fuel-pressure sensor(s) 158 in system 100 transmitted to the process controller 128. In embodiments, the fuel data 1110 may further include fuel composition information that is either sensed via a sensor located at the fuel source 108 or that is determined based on an inferred fuel composition as discussed below. The fuel data 1110 may also include data regarding other fuel-side sensors not necessarily shown in FIG. 1, but known in the art.

In embodiments, the sensor database 130 includes air data 1118 regarding the air being supplied to the burner 104 and heater 102. The air data 1118 includes air temperature data 1120, air humidity data 1122, and air pressure data 1124. The air temperature data 1120 includes sensed readings from any one or more of the air temperature sensor(s) 144 in system 100 transmitted to the process controller 128. The air humidity data 1122 includes sensed readings from any one or more of the air humidity sensor(s) 146 in system 100, and/or data from local weather servers, transmitted to the process controller 128. The air pressure data 1124 includes sensed readings from any one or more of the pre-burner air register air pressure sensor 148, and a post-burner air register air pressure sensor 150 (or any other air pressure sensor) in system 100 transmitted to the process controller 128. The air data 1118 may also include data regarding other air-side sensors not necessarily shown in FIG. 1, but known in the art.

In embodiments, the sensor database 130 includes heater data 1126. The heater data 1126 includes radiant-section temperature data 1128, convection-section temperature data 1130, stack-section temperature data 1132, radiant-section pressure data 1134, convection-section pressure data 1136, and stack-section pressure data 1138. The radiant-section temperature data 1128 includes sensed readings from the radiant temperature sensor(s) 142 of system 100 that are transmitted to the process controller 128. The convection-section temperature data 1130 includes sensed readings from the convection temperature sensor(s) 140 of system 100 that are transmitted to the process controller 128. The stack-section temperature data 1132 includes sensed readings from the stack temperature sensor(s) 138 of system 100 that are transmitted to the process controller 128. The radiant-section pressure data 1134 includes sensed readings from the radiant pressure sensor(s) 126 of system 100 that are transmitted to the process controller 128. The convection-section pressure data 1136 includes sensed readings from the convection pressure sensor(s) 127 of system 100 that are transmitted to the process controller 128. The stack-section pressure data 1136 includes sensed readings from the stack pressure sensor(s) 129 of system 100 that are transmitted to the process controller 128. The heater data 1126 may also include data regarding other heater sensors not necessarily shown in FIG. 1, but known in the art.

In embodiments, the sensor database 130 further includes emissions data 1140. The emissions data 1140 includes $O_2$ reading(s) 1142, CO reading(s) 1144, and $NO_X$ reading(s) 1146. The $O_2$ reading(s) 1142 include sensed readings from the oxygen sensor 132 transmitted to the process controller 128. The CO reading(s) 1144 include sensed readings from the carbon monoxide sensor 134 transmitted to the process controller 128. The $NO_X$ reading(s) 1146 include sensed readings from the $NO_X$ sensor 136 transmitted to the process controller 128. The emissions data 1140 may also include data regarding other emissions sensors not necessarily shown in FIG. 1, but known in the art.

In embodiments, the sensor database 130 includes process-side data 1170 regarding the conditions of the process tubes 106 and the process occurring. The process-side data 1170 includes process tube temperature 1172, and the outlet fluid temperature 1174. The process tube temperature 1172 may include data captured by the process tube temperature sensor 168, discussed above. The outlet fluid temperature 1174 may include data captured by an outlet fluid sensor (not shown), such as a thermocouple. The process-side data 1170 may also include data regarding other process-side sensors not necessarily shown in FIG. 1, but known in the art.

Data within the sensor database 130 is indexed according to the sensor providing said readings. Accordingly, data within the sensor database 130 may be used to provide real-time operating conditions of the system 100.

The memory 1104, in embodiments, further includes one or more of a fuel analyzer 1148, an air analyzer 1150, a draft analyzer 1152, an emissions analyzer 1154, a process-side analyzer 1176, and any combination thereof. Each of the fuel analyzer 1148, air analyzer 1150, draft analyzer 1152, emissions analyzer 1154, and process-side analyzer 1176 comprise machine readable instructions that when executed by the processor 1102 operate to perform the functionality associated with each respective analyzer discussed herein. Each of the fuel analyzer 1148, air analyzer 1150, draft analyzer 1152, emissions analyzer 1154, and process-side analyzer 1176 may be executed in serial or parallel to one another.

The fuel analyzer 1148 operates to compare the fuel data 1110 against one or more fuel alarm thresholds 1156. One common fuel alarm threshold 1156 includes fuel-pressure threshold that sets a safe operation under normal operating condition without causing nuisance shutdowns of the system 100 due to improperly functioning burner 104 caused by excess or low fuel-pressure. The fuel alarm thresholds 1156 are typically set during design of the system 100. The fuel analyzer 1148 may analyze other data within the sensor database 130 not included in the fuel data 1110, such as any one or more of air data 1118, heater data 1126, emissions data 1140, process-side data 1170, and any combination thereof to ensure there is appropriate air to fuel ratio within the heater to achieve the stoichiometric conditions for appropriate generation of the thermal energy 112.

The air analyzer 1150 operates to compare the air data 1118 against one or more air alarm thresholds 1158. One common air alarm threshold 1158 includes fan operating threshold that sets a safe operation condition of the forced fan 124 and/or stack fan 122 under normal operating condition without causing nuisance shutdowns of the system 100 due to improper draft within the heater 102 caused by excess or low air pressure throughout the system 100. The air alarm thresholds 1158 are typically set during design of the system 100. The air analyzer 1150 may analyze other data within the sensor database 130 not included in the air data 1118, such as any one or more of fuel data 1110, heater data 1126, emissions data 1140, process-side data 1170, and any combination thereof to ensure there is appropriate air to fuel ratio within the heater to achieve the stoichiometric conditions for appropriate generation of the thermal energy 112.

The draft analyzer 1152 operates to compare the heater data 1126 against one or more draft alarm thresholds 1160. One common draft alarm threshold 1160 includes heater pressure threshold that sets safe operation conditions of the heater 102 under normal operating condition without causing nuisance shutdowns or dangerous conditions of the system 100 due to positive pressure within the heater 102 (such as at the arch of the heater 102). The draft alarm thresholds 1160 are typically set during design of the system 100. The draft analyzer 1152 may analyze other data within the sensor database 130 not included in the heater data 1126, such as any one or more of fuel data 1110, air data 1118, emissions data 1140, process-side data 1170, and any combination thereof to ensure there is appropriate operating conditions within the heater 102 to achieve the stoichiometric conditions for appropriate generation of the thermal energy 112.

The emissions analyzer 1154 operates to compare the emissions data 1140 against one or more emission alarm thresholds 1162. One emissions alarm threshold 1162 include a minimum and maximum excess oxygen level that sets safe operation conditions of the heater 102 under normal operating condition without causing nuisance shutdowns or dangerous conditions of the system 100 due to too little or too much oxygen within the heater 102 during creation of the thermal energy 112. Other emission alarm thresholds 1162 include pollution limits set by environmental guidelines associated with the location in which system 100 is installed. The emission alarm thresholds 1162 are typically set during design of the system 100. The emissions analyzer 1154 may analyze other data within the sensor database 130 not included in the emissions data 1140, such as any one or more of fuel data 1110, air data 1118, heater data 1126, process-side data 1170, and any combination thereof to ensure there is appropriate operating conditions within the heater 102 to achieve the stoichiometric conditions for appropriate generation of the thermal energy 112.

The process-side analyzer 1176 operates to compare the process-side data 1170 against one or more process thresholds 1178. One common process threshold 1178 includes a desired outlet temperature to achieve efficient process conversion in the process tubes 106. Another example process threshold 1178 includes a maximum temperature threshold of the process tube 106 at which the process tube 106 is unlikely to fail. The process-side analyzer 1176 may analyze other data within the sensor database 130 not included in the process-side data 1170, such as any one or more of fuel data 1110, air-data 1118, heater data 1126, emissions data 1140, and any combination thereof to ensure there is appropriate air to fuel ratio within the heater to achieve the stoichiometric conditions for appropriate generation of the thermal energy 112.

The fuel analyzer 1148, the air analyzer 1150, the draft analyzer 1152, the emissions analyzer 1154, and the process-side analyzer 1176 operate to create one or more of control signals 1164, alarms 1166, and displayed operating conditions 1168. The control signals 1164 include signals transmitted from the process controller 128 to one or more components of the system 100, such as the dampers 118, air registers 120 (if electrically controlled), fans 122, 124, and valves 162. The alarms 1166 include audible, tactile, and visual alarms that are generated in response to tripping of one or more of the fuel alarm threshold 1156, air alarm threshold 1158, draft alarm threshold 1160, and emission alarm threshold 1162. The displayed operating conditions 1168 include information that is displayed on the display 1108 regarding the data within the sensor database 130 and the operating conditions analyzed by one or more of the fuel analyzer 1148, air analyzer 1150, draft analyzer 1152, emissions analyzer 1154, and process-side analyzer 1176.

Referring to FIG. 1, one or more of the fuel analyzer 1148, the air analyzer 1150, the draft analyzer 1152, the emissions analyzer 1154 and the process-side analyzer 1176 may be entirely or partially implemented on an external server 164. The external server 164 may receive some or all of the data within the sensor database 130 and implement specific algorithms within each of the fuel analyzer 1148, the air analyzer 1150, the draft analyzer 1152, the emissions analyzer 1154 and the process-side analyzer 1176. In response, the external server 164 may transmit one or more of the control signals 1164, the alarms 1166, and/or the displayed operating conditions 1168 back to the process controller 128. Inferring Fuel Composition When the combustion-system fuel-flow rate changes, the process controller 128 can also be configured to adjust the airflow rate accordingly. It is advantageous for combustion systems to utilize a minimal amount of "excess air" for combustion to maximize efficiency and emissions of the combustion system. Controlling the air to fuel ratio is done in a variety of different ways in the industry. One common way is to utilize a curve of fuel flow (based on a known fuel of known heating value) to airflow.

Such curve utilization generally works fine when the fuel composition is known, such as when the combustion process consistently utilizes the same fuel composition. Unfortunately, many applications of process burners and other combustion systems do not consistently use the same fuel composition. For example, process burners commonly utilize a waste fuel from processes that can have a widely varying composition and heating value. Such variations in fuel composition and heating value introduce a challenge for controlling air and fuel demand. In addition, air composition information varies frequently due to changes in ambient air conditions.

In applications with multiple fuel compositions, it is required to sample the fuel composition directly, and then use that new fuel composition to calculate the new required airflow. This method is typically compensated/biased by the excess oxygen measured within the firebox. This method is often not employed because full fuel composition-measurement devices that respond fast enough to be included in the control of the combustion system are often expensive and troublesome to maintain.

Accordingly, it is common in the process heater industry to apply a single fuel-air ratio curve of a known fuel (natural gas for instance), and then bias the curve based on easier to measure fuel property information. This method also biases based on the measured oxygen within the firebox. This approach allows some knowledge of fuel composition properties to be sampled faster and cheaper than measuring the full fuel composition. The problem with this approach is that the full fuel composition is never known, thus the required fuel air ratio is typically only approximated. In many cases, the fuel and air relationship is operated with a substantial excess air safety buffer to reduce risks associated with incomplete combustion. This strategy of providing a significant safety buffer can result in inefficient operation and/or increased emissions. Additionally, since the full fuel composition is not known, it cannot be recorded for troubleshooting or analytical purposes.

The present disclosure acknowledges these inefficiencies and utilizes systems and methods of determining an inferred composition of a fuel used in a combustion process to increase the control accuracy and efficiency of the overall system. The system and method determine a calculated fuel composition from measured properties of the combustion process, where the calculated fuel composition is derived from a physical relationship dependent on the composition of the fuel and one or more of the measured properties. The calculated fuel composition can be correlated with other such calculated fuel compositions and/or historical combustion data to determine the inferred composition of the fuel.

Figure 12:
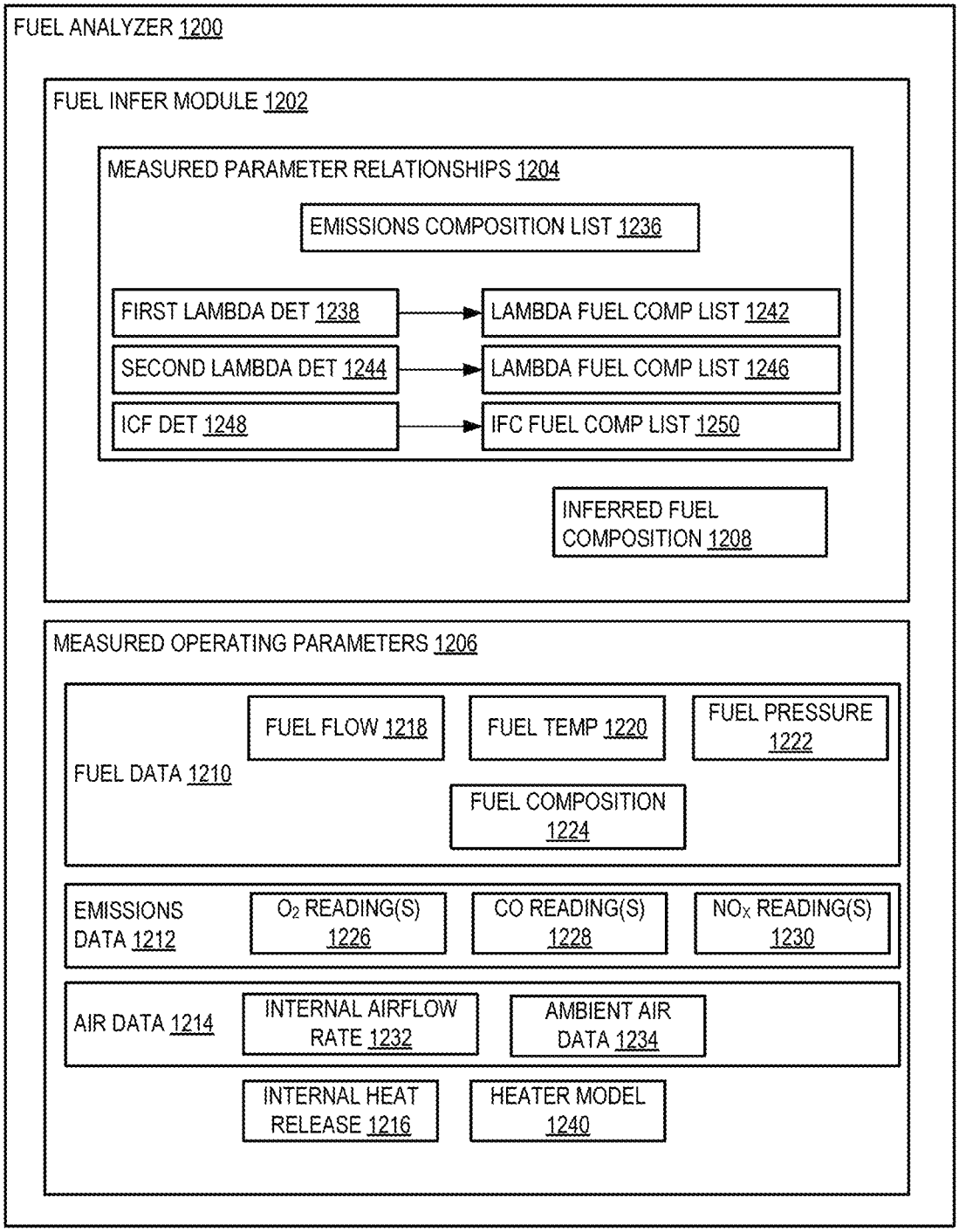
FIG. 12 depicts a fuel analyzer, which is an example of the fuel analyzer of FIG. 11, in an embodiment.

FIG. 12 depicts a fuel analyzer 1200, which is an example of the fuel analyzer 1148, of FIG. 11, in an embodiment. Fuel analyzer 1200 includes a fuel infer module 1202. Fuel infer module 1202 includes computer readable instructions that when executed by a processor (e.g., processor 1102), operate to compare identify one or more measured parameter relationships 1204 within measured operating parameters 1206 to identify an inferred fuel composition 1208.

The measured operating parameters 1208 characterize current combustion conditions of the combustion process. The measured operating parameters 1208 are mostly ones that are typically monitored in combustion processes. For example, the measured operating parameters 1208 include fuel data 1210, emissions data 1212, air data 1214, and internal heat release 1216.

The fuel data 1210 is an example of the fuel data 1110 of FIG. 11 and includes one or more of fuel flow 1218, fuel temperature 1220, fuel pressure 1222, fuel composition data 1224, and any combination thereof. The fuel flow data 1218 includes sensed readings from any one or more of the flow sensor(s) 154 in system 100 transmitted to the heater controller 128. The fuel temperature data 1220 includes sensed readings from any one or more of the fuel temperature sensor(s) 156 in system 100 transmitted to the heater controller 128. The fuel-pressure data 1222 includes sensed readings from any one or more of the fuel-pressure sensor(s) 158 in system 100 transmitted to the heater controller 128. The fuel composition data 1224 includes any information known about the fuel, such as hydrogen content of the fuel source 108, if known or sensed by a fuel composition sensor. In embodiments, the fuel composition data 1224 defines certain components of the fuel composition, such as hydrogen content, but not all content components.

The emissions data 1212 is an example of the emissions data 1140 of FIG. 11 and includes one or more of oxygen readings 1226, carbon monoxide readings 1228, and $NO_X$ readings 1230, and any combination thereof. The $O_2$ reading(s) 1226 include sensed readings from the oxygen sensor 132 transmitted to the heater controller 128. The CO reading(s) 1228 include sensed readings from the carbon monoxide sensor 134 transmitted to the heater controller 128. The $NO_X$ reading(s) 1230 include sensed readings from the $NO_X$ sensor 136 transmitted to the heater controller 128. The emissions data 1212 may also include data regarding other emissions sensors not necessarily shown in FIG. 1, but known in the art.

The air data 1214 is an example of the air data 1118 of FIG. 11, and includes both in-heater air data, such as internal air flow rate 1232, and exterior-heater air data, such as ambient data 1234. The internal airflow rate 1232 may include the draft within the heater 102 and within the ductwork 151 supplying the heater such that the pressure differential across each burner 104 is defined. The ambient air data 1234 may include air temperature, air humidity, air pressure, etc. sensed by sensors proximate the heater housing or obtained from a third-party weather server. The air data 1214 may also include data regarding other air-flow measurements (such as air temperature 1120, air humidity 1122, and air pressure 1124 discussed above).

The internal heat release 1216 includes the controlled heat release of the system 100 by the process controller 128. The internal heat release 1216 may additionally or alternatively be calculated based on in-heater sensed data, such as the internal temperature of the heater, the known amount of fuel injected into the system (e.g., based on the settings of the fuel control valve(s) 162, etc.).

By analyzing the measured operating parameters 1206 to identify the measured parameter relationships 1204 therein, the fuel infer module 1202 may compare the measured parameter relationships 1204 to identify an emissions fuel composition list 1236 defining known fuel compositions that result in the measured emissions data 1212, and identify the inferred fuel composition 1208 based on one of the fuel compositions in the emissions fuel composition list 1236 that is sufficiently likely to result in the measured parameter relationships 1204 (e.g., within a predefined likelihood threshold). In certain cases, there will be several relationships that are used to each produce one or more inferred fuel compositions; however, in some embodiments only a single physical relationship is used to produce the inferred fuel composition(s). In embodiments, the identified measured parameter relationships 1204 include one or more of lambda, mass flow rate of fuel, comparison of outlet emission mole fractions (e.g., $O_2$ mole fractions, CO mole fractions, NOx mole fractions, etc.), hydrogen content of the fuel, correlations of emissions from the combustion apparatus relative to the fuel composition, and any combination thereof.

In certain embodiments, the measured parameter relationships 1204 are defined by relationships within the emissions data 1212. As an example, the TDLAS device 147 may identify CO2 and H2O within the heater 102. These values may be used to regress to potential hydrogen to carbon relationships within the fuel, so long as the humidity in the air is accounted for as well as other firing configurations of the heater 102. As another example of measured parameter relationships 1204, the hydrogen to carbon relationship within the fuel may be inferred based on a known excess air (such as via the excess air calculations discussed in U.S. Provisional No. 62/864,967, filed Jun. 21, 2019 and which is incorporated by reference as if set forth in its entirety), and the measured Oxygen concentration within the heater 102.

Figure 14:
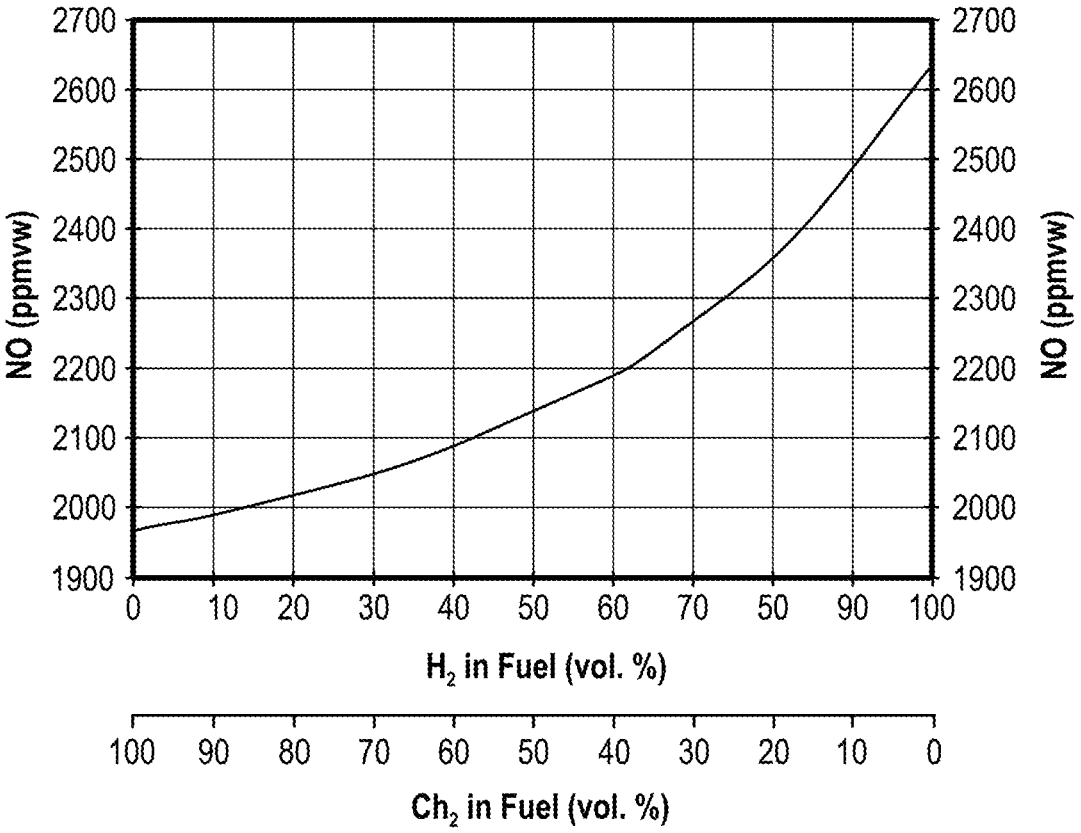
FIG. 14 depicts the hydrogen effects on $NO_X$ readings, in an example for a given heater.
Figure 15:
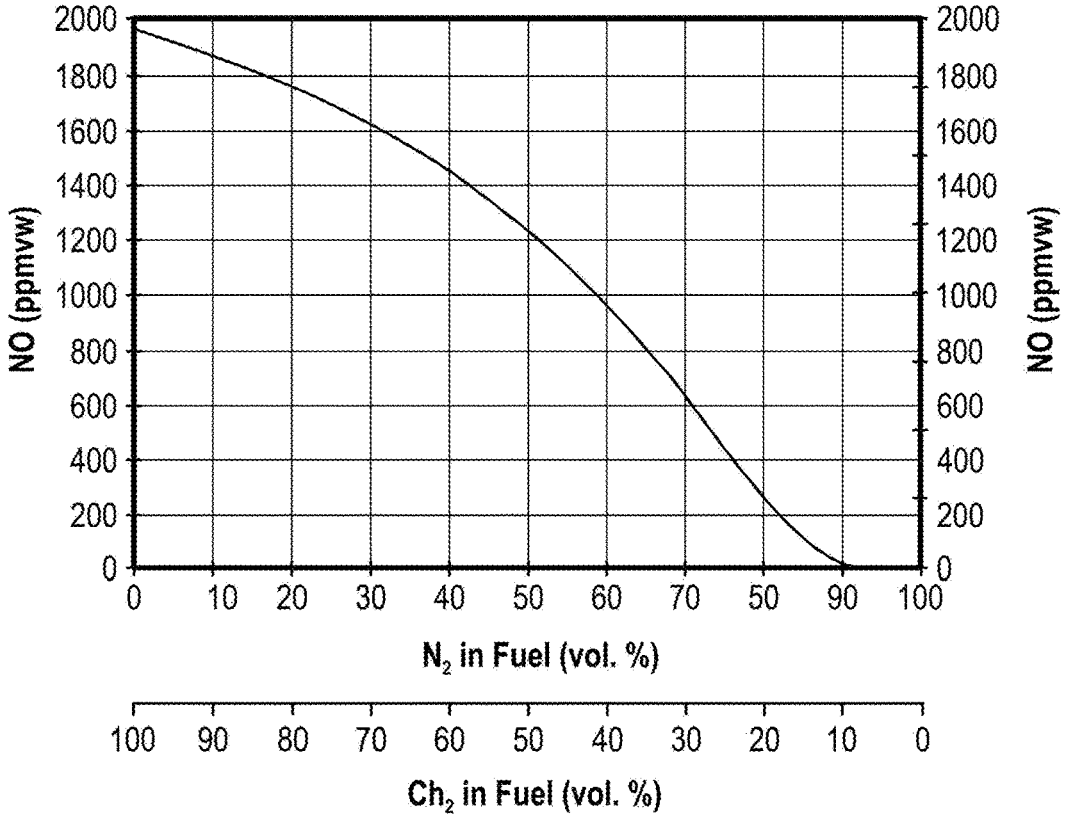
FIG. 15 depicts example nitrogen effects on $NO_X$, in an example for a given heater.
Figure 16:
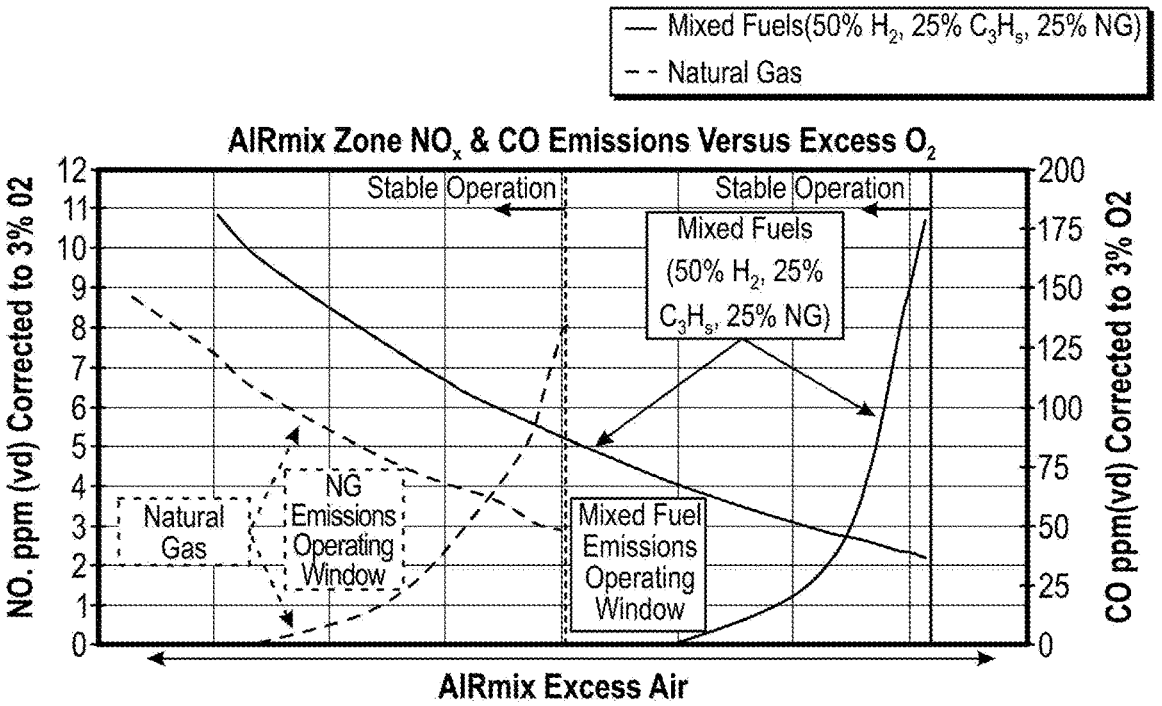
FIG. 16 depicts NOx and carbon monoxide readings for natural gas and mixed fuels of 50% $H_2$, 25% $C_3H_8$, and 25% Natural Gas, in an example for a given heater and excess air values.

As other examples of the measured parameter relationships 1204 that are defined by relationships within the emissions data 1212, FIG. 13 depicts example mechanisms that form $NO_X$ emissions within the system 100. The thermal and prompt $NO_X$ are two prominent contributors that are fuel dependent. Thus, the $NO_X$ readings 1230 may be used by the fuel infer module 1202 to identify the inferred fuel composition 1208. Thus, in certain embodiments, the fuel infer module 1204 analyzes the measured parameter relationships 1204 to determine the emissions fuel composition list 1236 defining known fuel composition(s) that result in the sensed $NO_X$ readings 1230 for a given heater 102 based on a heater model 1240, and the measured operating parameters 1206 resulting in the internal heat release 1216 (including or defined by the internal heater temperature, the excess air, and the combustion air temperature). By regressing, based on the heater model 1240, the internal heat release 1216, and the measured operating parameters 1206, from the NOx readings 1230, the fuel infer module 1202 may identify the emissions fuel composition list 1236, and further identify the inferred fuel composition 1208 as a fuel composition within the emissions fuel composition list 1236 sufficiently likely to result in the measured operating parameters 1206. FIG. 14 depicts the hydrogen effects on $NO_X$ readings, in an example for a given heater. FIG. 15 depicts example nitrogen effects on $NO_X$, in an example for a given heater. In embodiments, the fuel infer module 1202 additionally or alternatively, analyzes different emissions, such as one or both of oxygen readings 1226 and carbon monoxide readings 1228. FIG. 16 depicts NOx and carbon monoxide readings for natural gas and mixed fuels of 50% $H_2$, 25% $C_3H_5$, and 25% Natural Gas, in an example for a given heater and excess air values. The charts in FIGS. 14-16 are example of prior fuel composition knowledge utilized by the fuel infer module 1202 used to generate the emissions fuel composition list 1236.

In certain embodiments, the fuel infer module 1202 additionally or alternatively calculates the sensed parameter relationship 1204 as a first determination of lambda 1238. The first determination of lambda 1238 includes the ratio of the actual flow rate of air to the stoichiometric flow rate of air. To determine the actual flow rate, the fuel infer module 1202 may analyze a heater model 1240 (including information about the burners 104), the ambient air data 1234, and the differential pressure across the burner defined by the internal airflow rate 1232. The stoichiometric flow rate of is defined by potential fuel compositions (molecular weight and oxygen demand), the ambient air data 1234, and the fuel flow rate 1218 (either sensed by a sensor, or determined via mathematical regression based on the heater model 1240, fuel temperature 1220 and fuel pressure 1222). Accordingly, a first lambda fuel composition list 1242 of potential fuel compositions may be determined by solving the first determination of lambda 1238. There may be, however, a plurality of compositions of the fuel that solve the equation for the first determination of lambda 1238 and thus fuel infer module 1202 may not be able to definitively infer the input fuel into the heater 100. Thus, the fuel infer module 1202 may analyze the emissions fuel composition list 1236 as discussed above to further reduce the potential fuel compositions in the first lambda fuel composition list 1242 to identify the inferred fuel composition 1208.

Accordingly, in certain embodiments, the fuel infer module 1202 additionally or alternatively calculates the sensed parameter relationship 1204 as a second determination of lambda 1242. The second determination of lambda 1242 uses the outlet $O_2$ mole fraction within the $O_2$ readings 1226 and the ambient air data 1234, to correlate fuel compositions (generation rates of $H_2O$ and $CO_2$, and $O_2$ demand) and generate a second lambda fuel composition list 1246 of potential fuel compositions. The fuel infer module 1202 may then additional analyze the first lambda fuel composition list 1242, and/or the emissions fuel composition list 1236 to identify fuel composition(s) not within each list to identify the inferred fuel composition 1208.

In embodiments, the fuel infer module 1202, additionally or alternatively, analyzes a sensed parameter relationship 1204 defined by isentropic compressible flow (ICF) relationship 1248 to identify an ICF fuel composition list 1250. The isentropic compressible flow relationship 1248 correlates the measured fuel flow 1218 of the fuel using isentropic compressible flow equations for an orifice (such as the fuel gas tip used to introduce fuel gas into the combustion process). For example, mass flow rate can be calculated from orifice size and fuel composition by a formula such as:

$$\dot{m}_{fuel} = C_D A(P_{Port} + P_{atm})\sqrt{\frac{\gamma}{RT}}\min\left[1, \sqrt{\frac{2}{\gamma-1}\left(\left(\frac{P_{fuel}+P_{atm}}{P_{atm}}\right)^{\frac{\gamma-1}{\gamma}} - 2\right)}\right]$$

Where $c_D$ is the discharge coefficient, A is the flow area of the orifice, $P_{port}$ is the fuel pressure upstream of the orifice ($P_{fuel}$ is the fuel pressure (e.g., fuel pressure 1222), $P_{atm}$ is the pressure downstream of the orifice—typically atmospheric pressure, and $\gamma$ is the heat capacity ratio, R is the ideal gas constant and T is a temperature Thus, by comparing the measured fuel flow 1218, the fuel infer module 1202 determines ICF fuel composition list 1250 of fuel compositions that would result in the measured mass flow 1218 under the conditions of the process burner. If the ICF fuel composition list 1250 includes a plurality of fuel compositions, then the fuel infer module 1202 may then additionally analyze one or more of the first lambda fuel composition list 1242, the second lambda fuel composition list 1246, and the emissions fuel composition list 1236 to identify fuel composition(s) not within each list to further reduce the potential fuel compositions in the third composition list 1242.

It should be appreciated, however, that the fuel infer module 1202 may identify any number of measured parameter relationships (e.g., the emissions fuel composition list 1235, the first lambda fuel composition list 1242, the second lambda fuel composition lists 1246, the ICF fuel composition list 1250, and any combination thereof. Further, the fuel infer module 1202 may analyze other relationships than the emissions data, the first lambda determination 1238, the second lambda determination 1244, and the ICF determination 1248. Any one or more of the identified (e.g., calculated and/or matched) fuel composition lists (e.g., the emissions composition list 1236, the first lambda fuel composition list 1242, the second lambda fuel composition lists 1246, the ICF fuel composition list 1250) may be reduced by the fuel infer module 1202 based on one or more of the other relationships to identify the inferred fuel composition 1208 as sufficiently likely to result in the measured operating parameters 1206. To reduce one or more fuel compositions discussed above including a plurality of potential fuel compositions, the fuel infer module 1202 may analyze one or more of:

(a) other calculated fuel compositions that satisfy one or more physical relationship for the combustion process, wherein the physical relationship is different from the first calculated fuel composition;

(b) historical data from the combustion of test fuels used to characterize the performance of the combustion apparatus carrying out the combustion process—typically such test fuels will be natural gas, hydrogen, propane, nitrogen and mixtures thereof;

(c) historical data from prior combustion fuels, wherein composition for each prior combustion fuel was determined by a fuel composition measuring device; and/or (d) historical data from prior combustion fuels, wherein an inferred composition was determined for the prior combustion fuel.

After the inferred fuel composition 1208 has been determined, it can be used to adjust or alter the combustion conditions in order to optimize the combustion process within the heater 102. In some embodiments, the altering of the combustion conditions can include one or more of altering airflow rate into the combustion process or altering fuel flow rate into the combustion process. For example, fuel flow rate can be accomplished by altering the fuel pressure prior to it entering the combustion zone, altering the fuel flow so that fuel flow is split between one or more nozzles—which can be primary and secondary nozzles as are known in the art. Additionally, the adjustments can include changing air inlet pressure, changing damper positions, and the like.

Also, in some embodiments, it can be advantageous to compare the inferred composition with a measured composition determined by a fuel composition-measuring device. As discussed above, generally fuel composition measuring devices will be slower than the current inferred fuel determination; thus, measuring the fuel composition by such devices can be problematic to maintaining an efficient combustion process. However, the comparison of inferred fuel composition with measured fuel composition can be used for support of the combustion process, such as to further adjust the combustion process, determine the accuracy of the inferred fuel composition and/or determine whether the composition-measuring device is functioning correct. For example, when the inferred composition and measured composition deviate in a predetermined manner or amount, an operator of the combustion process can be alerted that maintenance is needed. Accordingly, the inferred fuel composition can be utilized for improved air to fuel ratio control, optimization, troubleshooting, or instrumentation checking purposes.

Figure 17:
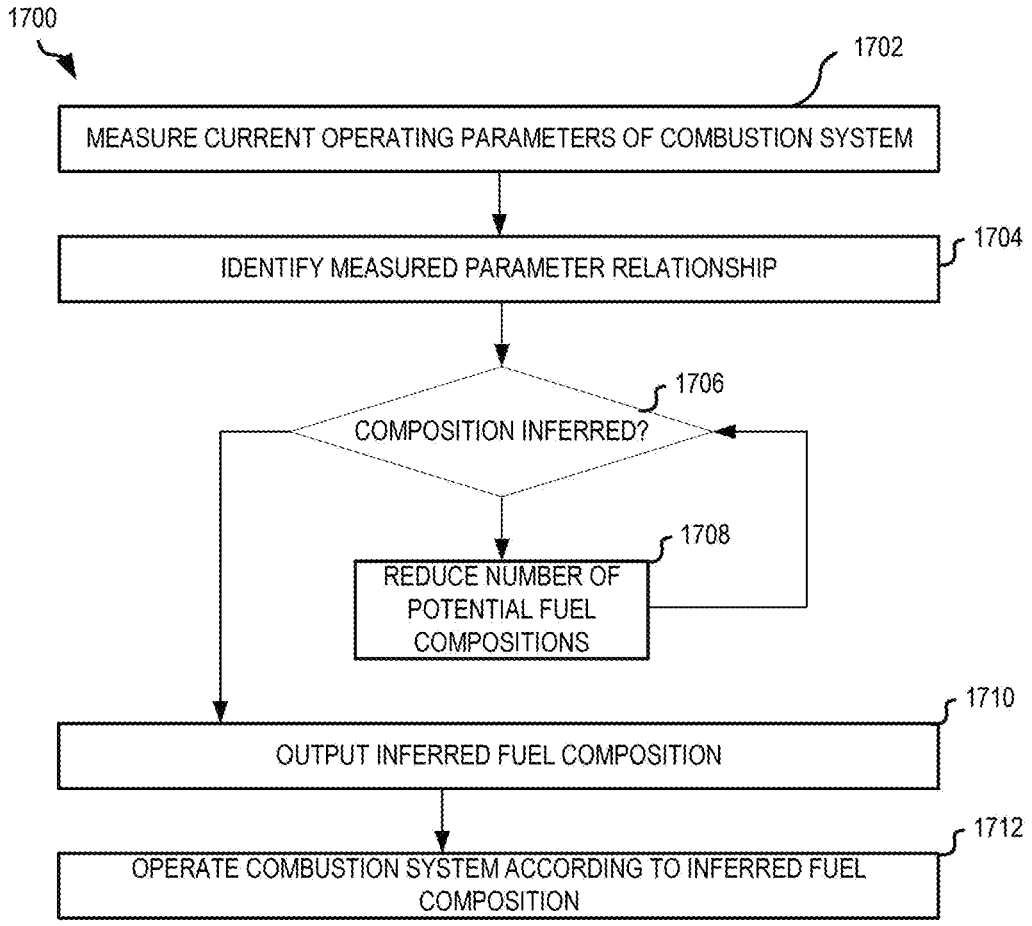
FIG. 17 depicts a method for inferring fuel composition within a combustion system, in embodiments.

FIG. 17 depicts a method 1700 for inferring fuel composition within a combustion system, in embodiments. Method 1700 may be implemented by the fuel infer module 1202 of the fuel analyzer 1200 discussed above.

In block 1702, method 1700 measures current operating parameters of the combustion system. In an example of block 1702, the fuel analyzer 1200 receives measured operating parameters 1206 including one or more of fuel data 1210, emissions data 1212, air data 1214, internal heat release 1216, and any combination thereof.

In block 1704, method 1700 identifies measured parameter relationship based on the measured current operating parameters of block 1702. In one example of block 1704, the fuel infer module 1202 identifies the measured parameter relationships 1204. Embodiments of block 1704 may identify any one or more of the measured parameter relationships 1204 discussed above, including but not limited to, the measured parameter relationships defined by relationships within the emissions data 1212, the first determination of lambda 1238, the second determination of lambda 1244, and the isentropic compressible flow relationship 1248, and any combination thereof. Block 1704 may include performing mathematical regressions on the measured operating parameters 1206 to identify fuel compositions that solve the heater model 1240. Block 1704 may include comparing the measured operating parameters 1206 to known relationships to identify which fuel compositions result in the conditions defined by the measured operating parameters 1206.

In block 1706, the method 1700 determines if the fuel composition is inferred to a sufficient degree of likelihood in resulting in the measured operating parameters. If no, method 1700 proceeds with block 1708. If yes, method 1700 proceeds with block 1710. In an example of block 1706, the fuel infer module 1202 determines if a single fuel composition identified by the measured parameter relationships 1204 has a sufficient likelihood of resulting in the measured operating parameters 1206. One embodiment of block 1706 may require that only a single fuel composition be identified out of a plurality of potential fuel compositions.

In block 1708, the method 1700 reduces the number of potential fuel compositions resulting in one or more measured parameter relationships. In one example of operation of block 1708, the method 1700 compares a first measured parameter relationship and one or more additional measured parameter relationships to reduce fuel compositions that do not satisfy both relationships. For example, to implement block 1708, the fuel infer module 1202 may determine and compare two or more of the emissions composition list 1236, the first lambda fuel composition list 1242, the second lambda fuel composition list 1246, and the ICF fuel composition list 1250. Block 1708 may be repeated to determine additional measured parameter relationships that result in the measured operating parameters to further reduce the potential fuel compositions and identify a fuel composition that is sufficiently likely to result in the measured operating parameters.

Embodiments of block 1708 may include analyzing any one or more of:

(a) other calculated fuel compositions that satisfy one or more physical relationship for the combustion process, wherein the physical relationship is different from the first calculated fuel composition;

(b) historical data from the combustion of test fuels used to characterize the performance of the combustion apparatus carrying out the combustion process—typically such test fuels will be natural gas, hydrogen, propane, nitrogen and mixtures thereof;

(c) historical data from prior combustion fuels, wherein composition for each prior combustion fuel was determined by a fuel composition measuring device; and/or (d) historical data from prior combustion fuels, wherein an inferred composition was determined for the prior combustion fuel.

At block 1710, the method 1700 outputs the inferred fuel composition. In one example of block 1710, the inferred fuel composition 1208 is output to the heater controller 128 and/or a mobile device of an operator of the system 100.

At block 1712, the combustion system is operated according to the inferred fuel composition. In one example of block 1712, the heater controller 128 calculates and generates control signals to change operation of the fuel to air ratio supplied by the burners 104 based on the inferred fuel composition 1208.

As used herein "inferred composition" or "inferred fuel composition" means a composition which is not determined by direct fuel sampling and analysis. Rather, the inferred composition is determined by correlating data to determine the most likely fuel composition or even a unique fuel composition that matches the available data.

As will be understood from the above, the inferred fuel composition can be accurately achieved because burner performance is strongly correlated with fuel composition. Moreover, the inferred fuel composition can be based on calculated fuel composition for the current fuel, historical fuel compositions (both inferred fuel compositions and measured fuel compositions) and/or test data recorded throughout wide ranges of potential fuel compositions. The larger and more dynamic the data set, the better the correlation of common combustion measurements, and thus the better the correlation of inferred fuel composition to the actual fuel composition.

In many combustion systems, the equipment is required to undergo a factory test, proving the burner can maintain combustion (is stable) throughout its entire operating range.

It is also required in many cases for the supplier to prove the burner can achieve the emissions performance as required by the regulating bodies. To perform the combustion test, a range of expected customer fuel compositions is provided to the supplier. It is common for the supplier to take a list of the customer fuel compositions and create a "simulation" test fuel that matches the heating value, molecular weight, and some other key fuel composition properties. Creating this simulated test fuel, allows for the performance of a fuel to be demonstrated to a customer with 1-5 readily available fuel components (such as natural gas, hydrogen, propane, and nitrogen) instead of trying to match the customer fuel exactly as it may have 10-50 fuel components within the composition. This approach provides a ready source of historical data to be used test data for the correlation to determine inferred fuel compositions in accordance with the method described in this disclosure.

Cloud Computing Embodiments

In embodiments, a portion or all of the fuel analyzer 1200 may be implemented remotely from the process controller 128, such as in the network-based "cloud", where the airflow analyzer 1200 and the heater controller 128 are a portion of an edge computing scheme. For example, the heater model 1240 in the fuel analyzer 1200, and fuel infer module 1202 may be stored and executed at the external server 164, such that after the inferred fuel composition 1208 is generated, the inferred fuel composition 1208 then transmitted from the external server 164 to the heater controller 128 for display on the display 1108 thereof or used automatic control of the hardware associated the heater 102. The measured operating parameters 1206 may be gathered at the process controller 128 (such as at the system DCS or PLC (plant control system) and transmitted to the external server 164 for analysis by the fuel analyzer 1200. Alternatively, or additionally, one or more of the devices capturing the measured operating parameters 1206 may be an embedded device having data transmission capability that transfers its respective data directly to the external server 164 for analysis by the fuel analyzer 1200.

System Component Validation:

Continued understanding on the modeling side (either via the fuel analyzer 1200, or other physics-based modeling, or analytics discussed herein or in any of the above referenced related and priority applications that are incorporated by reference herein) allows for the process controller 128 to monitor and validate the measurement devices that populate the data within the sensor database 130. Because the modeling provides optimized control settings, the analyzers discussed herein are able to compare the measured data to the expected data generated via calculations. If the measured data varies with respect to the calculated data, the system is able to troubleshoot the particular reason for that discrepancy.

For example, a variation in a fuel-side calculation may indicate that the calculated heat release based on pressure with clean burner tips is higher than a given fuel mass flow measurement. In such situation, the fuel analyzer 1148 may implement the following troubleshooting: (i) identify that one or more of the burners are out of service, (ii) determine if one or more of the fuel valves are full-open (even though they are supposed to be at a specific setting), (iii) determine if the burner tips have additional fouling that is visually identifiable, (iv) determine if the burner tips have a different orifice diameter than expected, and (v) determine if the pressure transmitter or flow meter providing the measurements are in need of calibration.

As another example, a variation in a fuel-side calculation may indicate that the calculated heat release based on pressure with clean burner tips is lower than a given mass flow measurement. In such situation, the fuel analyzer 1148 may implement the following troubleshooting: (i) confirm quantity of out-of-service burners, (ii) verify that the out-of-service burners are truly out of service, (iii) determine if there are gas leaks within the combustion system (visually observed by small "candle flames" until the tip is plugged), (iv) determine if flame patterns match conditions indicating missing burner tips or burner tips that have ports that are eroded, (v) confirm burner tip orifice diameter, (vi) determine improper line loss calculations, (vii) determine if the pressure transmitter or flow meter providing the measurements are in need of calibration.

As another example, a variation in an air-side calculation may indicate that the calculated oxygen is higher than a measured oxygen level. In such situation, the air-side analyzer 1150 (or the emissions analyzer 1154) may implement the following troubleshooting process: (i) confirm the number of burners out-of-service, (ii) confirm that the air register settings are accurate within the model, (iii) analyze the burners for blocked air passages, such as blocked air inlets, refractory fallen into burner throats, wall burner air-tip fouling, loos burner insulation, flashback or combustion back pressure within the burner, (iv) determine potential leaks within the process tubes (and shut down if so), (v) verify ambient air conditions, (vi) check wind speeds, (vii) calibrate air-side measurement devices such as the air-pressure and O2 analyzer.

As another example, a variation in an air-side calculation may indicate that the calculated oxygen is lower than a measured oxygen level. In such situation, the air-side analyzer 1150 (or the emissions analyzer 1154) may implement the following troubleshooting process: (i) confirm the number of burners out-of-service, (ii) confirm that the air register settings are accurate within the model, (iii) analyze for tramp-air entering the system (such as via sight ports, lighting ports, gas tip riser mounting plates, etc.), (iv) determine potential leaks within the process tubes (and shut down if so), (v) verify ambient air conditions, (vi) check wind speeds, (vii) analyze for additional gas leakage into the system, (viii) calibrate air-side measurement devices such as the air-pressure and O2 analyzer.

Definitions

The disclosure herein may reference "physics-based models" and transforming, interpolating, or otherwise calculating certain data from other data inputs. Those of ordinary skill in the art should understand what physics-based models incorporate, and the calculations necessary to implement said transforming, interpolating, or otherwise calculating for a given situation. However, the present disclosure incorporates by reference chapter 9 of the "John Zink Hamworthy Combustion Handbook", which is incorporated by reference in its entirety (Baukal, Charles E. The John Zink Hamworthy Combustion Handbook. Fundamentals. 2nd ed., vol. 1 of 3, CRC Press, 2013) for further disclosure related to understanding of fluid dynamics physics-based modeling and other calculations. It should be appreciated, however, that "physics-based models" and transforming, interpolating, or otherwise calculating certain data from other data inputs is not limited to just those fluid dynamics calculations listed in chapter 9 of the John Zink Hamworthy Combustion Handbook.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

Any of the functionality described herein may be combined, in any combination, with the functionality described in the attached appendices. Such combinations include using given outputs from the various described "analyzers" to identify further insights into the control of the described combustion systems, as will be appreciated by those of ordinary skill in the art. Examples of combinations of features include:

(A1) In a first aspect, a combustion system includes: a processor; and a memory operatively coupled to the processor and storing: a fuel infer module comprising computer readable instructions that when executed by the processor operate to: receive measured operating parameters including one or more of fuel data defining fuel characteristics used in combustion within a heater of the combustion system, emissions data defining emission gasses exiting the heater, airflow data defining ambient air being supplied to the heater and airflow rate of the air within the heater, and, identify one or more relationships within the measured operating parameters that result in a list of potential fuel compositions, select one of the potential fuel compositions from the list having sufficient likelihood of resulting in the measured operating parameters as an inferred fuel composition; output the inferred fuel composition to a heater controller of the heater.

(A2) In an embodiment of (A1), the computer readable instructions that identify one or more relationships within the measured operating results including computer readable instructions that when executed by the processor operate to identify emissions fuel composition list defining known fuel compositions that result in the measured emissions data.

(A3) In an embodiment of (A2), the emissions data including NOX readings, the computer readable instructions that identify emissions fuel composition list including computer readable instructions that when executed by the processor operate to identify the emissions fuel composition list defining the known fuel compositions that result in the NOX readings based on analysis of a heater model of the heater and a known internal heat release within the heater.

(A4) In an embodiment of any of (A1)-(A3), the emissions data further including one or more of CO, and oxygen readings the computer readable instructions further operating to reduce a number of fuel compositions defined in the emissions fuel composition list based on a determination of whether each fuel composition defined in the emissions composition list results in one or both of the CO and oxygen readings.

(A5) In an embodiment of any of (A2)-(A3), the emissions data including one or more of NOX, CO, and oxygen readings, the computer readable instructions that identify emissions fuel composition list including computer readable instructions that when executed by the processor operate to identify the emissions fuel composition list defining the known fuel compositions that result in one or more of the NOX, CO, and oxygen readings based on analysis of a heater model of the heater and a known internal heat release within the heater.

(A6) In an embodiment of any of (A1)-(A5), the computer readable instructions that identify one or more relationships within the measured operating results including computer readable instructions that when executed by the processor operate to identify a first lambda fuel composition list defining the list of potential fuel compositions based on first determination of lambda including a ratio of an actual flow rate of air within the heater to the stoichiometric flow rate of air within the heater.

(A7) In an embodiment of any of (A6), the computer readable instructions further operating to identify the actual flow rate of air based on a heater model, the ambient air data, and differential pressure across one or more burners within the heater.

(A8) In an embodiment of any of (A6)-(A7), the stoichiometric flow rate of air based on potential fuel compositions, the ambient air data, and fuel flow rate defined in the fuel data.

(A9) In an embodiment of any of (A6)-(A8), the computer readable instructions further operating to analyze an emissions fuel composition list to reduce the potential fuel compositions defined in the first lambda fuel composition list.

(A10) In an embodiment of any of (A6)-(A9), the computer readable instructions further operating to analyze a second lambda fuel composition list to reduce the potential fuel compositions defined in the first lambda fuel composition list.

(A11) In an embodiment of any of (A6)-(A10), the computer readable instructions further operating to analyze an Isentropic Compressible Flow (ICF) fuel composition list to reduce the potential fuel compositions defined in the first lambda fuel composition list.

(A12) In an embodiment of any of (A1)-(A11), the computer readable instructions that identify one or more relationships within the measured operating results including computer readable instructions that when executed by the processor operate to identify a second lambda fuel composition list defining the list of potential fuel compositions based on a second determination of lambda based on an outlet O2 mole fraction within the emissions data, and the ambient air data.

(A13) In an embodiment of any of (A12), the computer readable instructions further operating to analyze one or both of an emissions fuel composition list and a first lambda fuel composition list to reduce the potential fuel compositions defined in the second lambda fuel composition list.

(A14) In an embodiment of any of (A12)-(A13), the computer readable instructions further operating to analyze a first lambda fuel composition list to reduce the potential fuel compositions defined in the second lambda fuel composition list.

(A15) In an embodiment of any of (A12)-(A14), the computer readable instructions further operating to analyze an Isentropic Compressible Flow (ICF) fuel composition list to reduce the potential fuel compositions defined in the second lambda fuel composition list.

(A16) In an embodiment of any of (A1)-(A15), the computer readable instructions that identify one or more relationships within the measured operating results including computer readable instructions that when executed by the processor operate to identify an isentropic compressible flow fuel composition list defining the list of potential fuel compositions based on an Isentropic Compressible Flow (ICF) relationship that correlates a list of potential fuel compositions that would result in a measured mass fuel flow rate.

(A17) In an embodiment of any of (A16), the computer readable instructions further operating to analyze one or both of an emissions fuel composition list and a first lambda fuel composition list to reduce the potential fuel compositions defined in the ICF fuel composition list.

(A18) In an embodiment of any of (A16)-(A17), the computer readable instructions further operating to analyze a first lambda fuel composition list to reduce the potential fuel compositions defined in the ICF fuel composition list.

(A19) In an embodiment of any of (A16)-(A18), the computer readable instructions further operating to analyze a second lambda fuel composition list to reduce the potential fuel compositions defined in the ICF fuel composition list.

(A20) In an embodiment of any of (A1)-(A19), the fuel infer module executed remotely from the heater at a cloud server, and transmitting the inferred fuel composition from the cloud server to a heater controller local to the heater.

(B1) In a second aspect, a method for inferring fuel composition in a combustion system, includes: receive measured operating parameters including one or more of fuel data defining fuel characteristics used in combustion within a heater of the combustion system, emissions data defining emission gasses exiting the heater, airflow data defining ambient air being supplied to the heater and airflow rate of the air within the heater, and, identify one or more relationships within the measured operating parameters that result in a potential fuel composition list, select one of the potential fuel compositions from the list having sufficient likelihood of resulting in the measured operating parameters as an inferred fuel composition; output the inferred fuel composition to a heater controller of the combustion system.

(B2) In an embodiment of (B1), the emissions data further including one or more of NOX, CO, and oxygen readings, the method further comprising identifying the potential emissions fuel composition list defining the known fuel compositions that result in one or more of the NOX, CO, and oxygen readings based on analysis of a heater model of the heater and a known internal heat release within the heater.

(B3) In an embodiment of any of (B1)-(B2), the identifying one or more relationships including identify a first lambda fuel composition list defining the list of potential fuel compositions based on first determination of lambda including a ratio of an actual flow rate of air within the heater to the stoichiometric flow rate of air within the heater.

(B4) In an embodiment of any of (B3), further comprising: identifying the actual flow rate of air based on a heater model, the ambient air data, and differential pressure across one or more burners within the heater.

(B5) In an embodiment of any of (B3)-(B4), the stoichiometric flow rate of air based on potential fuel compositions, the ambient air data, and fuel flow rate defined in the fuel data.

(B6) In an embodiment of any of (B3)-(B5), further comprising: analyzing a second lambda fuel composition list to reduce the potential fuel compositions defined in the first lambda fuel composition list.

(B7) In an embodiment of any of (B3)-(B6), further comprising: analyzing an Isentropic Compressible Flow (ICF) fuel composition list to reduce the potential fuel compositions defined in the first lambda fuel composition list.

(B8) In an embodiment of any of (B1)-(B7), further comprising: analyzing one or both of an emissions fuel composition list and a first lambda fuel composition list to reduce the potential fuel compositions defined in the second lambda fuel composition list.

(B9) In an embodiment of any of (B1)-(B8), further comprising: identifying an isentropic compressible flow fuel composition list defining the list of potential fuel compositions based on an Isentropic Compressible How (ICF) relationship that correlates a list of potential fuel compositions that would result in a measured mass fuel flow rate.

(B10) In an embodiment of any of (B1)-(B9), further including the features from any of (A1)-(A20).

What is claimed is:

1. A combustion system, comprising:

a processor; and a memory operatively coupled to the processor and storing: a fuel infer module comprising computer readable instructions that when executed by the processor operate to:

receive measured operating parameters comprising two or more of fuel data defining fuel characteristics used in combustion within a heater of the combustion system, emissions data defining emission gasses exiting the heater, and airflow data defining ambient air being supplied to the heater and airflow rate of air within the heater;

identify one or more relationships within the measured operating parameters that result in a list of potential fuel compositions;

select one of the potential fuel compositions from the list having sufficient likelihood of resulting in the measured operating parameters as an inferred fuel composition; and output the inferred fuel composition to a heater controller of the heater.

2. The combustion system of claim 1, the computer readable instructions that identify one or more relationships within the measured operating parameters comprising computer readable instructions that when executed by the processor operate to identify emissions fuel composition list defining known fuel compositions that result in the emissions data.

3. The combustion system of claim 2, the emissions data comprising $NO_X$ readings, the computer readable instructions that identify the emissions fuel composition list comprising computer readable instructions that when executed by the processor operate to identify the emissions fuel composition list defining the known fuel compositions that result in the $NO_X$ readings based on analysis of a heater model of the heater and a known internal heat release within the heater.

4. The combustion system of claim 3, the emissions data further comprising one or more of CO, and oxygen readings the computer readable instructions further operating to reduce a number of fuel compositions defined in the emissions fuel composition list based on a determination of whether each fuel composition defined in the emissions composition list results in one or both of the CO and oxygen readings.

5. The combustion system of claim 2, the emissions data comprising one or more of $NO_X$, CO, and oxygen readings, the computer readable instructions that identify emissions fuel composition list comprising computer readable instructions that when executed by the processor operate to identify the emissions fuel composition list defining the known fuel compositions that result in one or more of the $NO_X$, CO, and oxygen readings based on analysis of a heater model of the heater and a known internal heat release within the heater.

6. The combustion system of claim 1, the computer readable instructions that identify one or more relationships within the measured operating parameters comprising computer readable instructions that when executed by the processor operate to identify a first lambda fuel composition list defining the list of potential fuel compositions based on first determination of lambda comprising a ratio of an actual flow rate of air within the heater to a stoichiometric flow rate of air within the heater.

7. The combustion system of claim 6, the computer readable instructions further operating to identify the actual flow rate of air based on a heater model, the ambient air data, and differential pressure across one or more burners within the heater.

8. The combustion system of claim 6, the stoichiometric flow rate of air based on potential fuel compositions, the ambient air data, and fuel flow rate defined in the fuel data.

9. The combustion system of claim 6, the computer readable instructions further operating to analyze an emissions fuel composition list to reduce the potential fuel compositions defined in the first lambda fuel composition list.

10. The combustion system of claim 6, the computer readable instructions further operating to analyze a second lambda fuel composition list to reduce the potential fuel compositions defined in the first lambda fuel composition list.

11. The combustion system of claim 6, the computer readable instructions further operating to analyze an Isentropic Compressible Flow (ICF) fuel composition list to reduce the potential fuel compositions defined in the first lambda fuel composition list.

12. The combustion system of claim 1, the computer readable instructions that identify one or more relationships within the measured operating parameters comprising computer readable instructions that when executed by the processor operate to identify a second lambda fuel composition list defining the list of potential fuel compositions based on a second determination of lambda based on an outlet O2 mole fraction within the emissions data, and the ambient air data.

13. The combustion system of claim 12, the computer readable instructions further operating to analyze one or both of an emissions fuel composition list and a first lambda fuel composition list to reduce the potential fuel compositions defined in the second lambda fuel composition list.

14. The combustion system of claim 12, the computer readable instructions further operating to analyze a first lambda fuel composition list to reduce the potential fuel compositions defined in the second lambda fuel composition list.

15. The combustion system of claim 12, the computer readable instructions further operating to analyze an Isentropic Compressible Flow (ICF) fuel composition list to reduce the potential fuel compositions defined in the second lambda fuel composition list.

16. The combustion system of claim 1, the computer readable instructions that identify one or more relationships within the measured operating parameters comprising computer readable instructions that when executed by the processor operate to identify an isentropic compressible flow fuel composition list defining the list of potential fuel compositions based on an Isentropic Compressible Flow (ICF) relationship that correlates a list of potential fuel compositions that would result in a measured mass fuel flow rate.

17. The combustion system of claim 16, the computer readable instructions further operating to analyze one or both of an emissions fuel composition list and a first lambda fuel composition list to reduce the potential fuel compositions defined in the ICF fuel composition list.

18. The combustion system of claim 16, the computer readable instructions further operating to analyze a first lambda fuel composition list to reduce the potential fuel compositions defined in the ICF fuel composition list.

19. The combustion system of claim 16, the computer readable instructions further operating to analyze a second lambda fuel composition list to reduce the potential fuel compositions defined in the ICF fuel composition list.

20. The combustion system of claim 1, the fuel infer module executed remotely from the heater at a cloud server, and transmitting the inferred fuel composition from the cloud server to a heater controller local to the heater.

21. A method for inferring fuel composition in a combustion system, comprising:

receiving measured operating parameters comprising two or more of fuel data defining fuel characteristics used in combustion within a heater of the combustion system, emissions data defining emission gasses exiting the heater, airflow data defining ambient air being supplied to the heater, and airflow rate of air within the heater;

identifying one or more relationships within the measured operating parameters that result in a potential fuel composition list;

selecting one of the potential fuel compositions from the potential fuel composition list having sufficient likelihood of resulting in the measured operating parameters as an inferred fuel composition; and outputting the inferred fuel composition to a heater controller of the combustion system.

22. The method of claim 21, the emissions data further comprising one or more of $NO_X$, CO, and oxygen readings, the method further comprising identifying a potential emissions fuel composition list defining known fuel compositions that result in one or more of the $NO_X$, CO, and oxygen readings based on analysis of a heater model of the heater and a known internal heat release within the heater.

23. The method of claim 21, the identifying one or more relationships comprising identifying a first lambda fuel composition list defining the potential fuel composition list based on first determination of lambda comprising a ratio of an actual flow rate of air within the heater to a stoichiometric flow rate of air within the heater.

24. The method of claim 23, further comprising: identifying the actual flow rate of air based on a heater model, the ambient air data, and differential pressure across one or more burners within the heater.

25. The method of claim 23, the stoichiometric flow rate of air based on potential fuel compositions, the ambient air data, and fuel flow rate defined in the fuel data.

26. The method of claim 23, further comprising: analyzing a second lambda fuel composition list to reduce the potential fuel compositions defined in the first lambda fuel composition list.

27. The method of claim 23, further comprising: analyzing an Isentropic Compressible Flow (ICF) fuel composition list to reduce the potential fuel compositions defined in the first lambda fuel composition list.

28. The method of claim 26, further comprising: analyzing one or both of an emissions fuel composition list and a first lambda fuel composition list to reduce the potential fuel compositions defined in the second lambda fuel composition list.

29. The method of claim 21, further comprising: identifying an isentropic compressible flow fuel composition list defining the potential fuel composition list based on an Isentropic Compressible Flow (ICF) relationship that correlates a list of potential fuel compositions that would result in a measured mass fuel flow rate.

* * * * *